US006987936B2

(12) United States Patent
Satoh et al.

(10) Patent No.: US 6,987,936 B2
(45) Date of Patent: Jan. 17, 2006

(54) IMAGE FORMING APPARATUS, IMAGE FORMING METHOD, AND FIXING UNIT

(75) Inventors: Naoki Satoh, Tokyo (JP); Ryo Takamatsu, Tokyo (JP); Yuusuke Ishizaki, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 22 days.

(21) Appl. No.: 10/859,968

(22) Filed: Jun. 4, 2004

(65) Prior Publication Data

US 2005/0013626 A1 Jan. 20, 2005

(30) Foreign Application Priority Data

Jun. 5, 2003 (JP) ..... 2003-161331
May 31, 2004 (JP) ..... 2004-161777

(51) Int. Cl.
*G03G 15/00* (2006.01)

(52) U.S. Cl. ..... 399/88; 399/320

(58) Field of Classification Search ..... 399/88, 399/16, 36, 37, 82, 320, 328, 335
See application file for complete search history.

(56) References Cited

U.S. PATENT DOCUMENTS

2003/0035128 A1 * 2/2003 Phillips et al. ..... 358/1.14
2004/0202490 A1 * 10/2004 Okamoto ..... 399/69

FOREIGN PATENT DOCUMENTS

JP 04060572 A * 2/1992
JP 10-282821 10/1998
JP 2001-45678 2/2001
JP 2001-212983 8/2001
JP 2002-184554 6/2002

* cited by examiner

*Primary Examiner*—Quana Grainger
(74) *Attorney, Agent, or Firm*—Oblon, Spivak, McClelland, Maier & Neustadt, P.C.

(57) ABSTRACT

An image forming apparatus includes a fixing unit that thermally fixes a toner image, a power control unit that controls a power supply from an auxiliary power supply to the fixing unit, a job-turnaround-time predicting unit that predicts a job turnaround time for executing an image forming job, a charging-time predicting unit that predicts a charging time for charging the auxiliary power supply, and a control unit that controls a charging operation for the auxiliary power supply and execution of the image forming job based on the job turnaround time predicted and the charging time predicted, such that the job turnaround time for the image forming job is minimized.

16 Claims, 20 Drawing Sheets

IMAGE FORMING APPARATUS, IMAGE FORMING METHOD, AND FIXING UNIT

CROSS-REFERENCE TO RELATED APPLICATIONS

The present document incorporates by reference the entire contents of Japanese priority documents, 2003-161331 filed in Japan on Jun. 5, 2003 and 2004-161777 filed in Japan on May 31, 2004.

BACKGROUND OF THE INVENTION

1) Field of the Invention

The present invention relates to an image forming apparatus, an image forming method, and a fixing unit, and more particularly, to an image forming apparatus like a copying machine, a digital multifunction product, and a printer that apply heat to a fixing member of a fixing unit using an auxiliary power supply, an image forming method, and a fixing unit that is used in the image forming apparatus.

2) Description of the Related Art

The image forming apparatus such as the copying machine or the printer forms an image on a recording medium like plain paper or an OHP transparency. In this image formation, an electrophotographic system is adopted taking into account high speed of the image formation, an image quality, cost, and the like. The electrophotographic system is a system in which a toner image is formed on a recording medium and fixed on the recording medium with heat and pressure. As a fixing system, a heat roll system is adopted most frequently at present in terms of safety and the like. The heat roll system is a system in which a heating roller, which is heated by a heat generation member like a halogen heater, and a pressurizing roller, which is arranged to be opposed to the heating roller, are brought into pressed contact with each other to form a mutual press-contact section called a nip section, and the recording medium having the toner image transferred thereon through is passed through this nip section and heated.

In recent years, environmental problems have increased in importance, and efforts have been made to reduce energy consumption in the image forming apparatus such as the copying machine or the printer. What cannot be neglected in considering the reduction of energy consumption in the image forming apparatus is power saving in the fixing unit that fixes toner on a recording medium.

In realizing power saving, it is effective to reduce energy consumption when the fixing unit is on standby. Thus, it is desirable to reduce power supply to zero when the fixing unit is not used. However, in a conventional structure for the fixing unit, if power is reduced to zero when the fixing unit is on standby, it takes time to warm up a heating roller thereof when the fixing unit is used again. This makes waiting time longer and deteriorates convenience for a user. Consequently, a structure for increasing temperature of the heating roller rapidly has been required.

To reduce the warm-up time for the heating roller, it is effective to increase input energy per a unit time, that is, rated power. Actually, in some high-speed image forming apparatuses with high print speed, a supply voltage is increased to 200 volts to increase the rated power. However, in typical offices in Japan, in general, a power supply has an upper limit of 100 V/15 A (1500 W), and it is necessary to apply special work to power supply related facilities in a place where an image forming apparatus is set. Thus, it cannot be said that this is a general solution. Therefore, the fact of the matter is that, even if it is attempted to warm up the heating roller in a short time, the upper limit of the input energy cannot be lifted.

In addition, there is a method of reducing thickness of the heating roller to warm up the heating roller in a short time. However, since a thermal capacity of the heating roller decreases, in the case of an image forming apparatus with high print speed, temperature may fall if continuous printing is performed even in a state in which temperature on the surface of the heating roller has risen to a set temperature.

To improve the warm-up of the heating roller, power is accumulated in an auxiliary power supply in advance and the power is supplied from the auxiliary power supply at the time of power shortage. This makes it possible to solve the problem of the fall in temperature at the time of a print operation.

For example, Japanese Patent Application Laid-Open Publication No. Hei 10-282821 proposes a technique for increasing maximum supply power using an auxiliary power supply in a fixing unit to thereby realize reduction in energy consumption. Such a fixing unit disclosed in Japanese Patent Application Laid-Open Publication No. Hei 10-282821 supplies power from a main power supply unit and a secondary battery or a primary battery and uses a nickel-cadmium battery or a lead-acid battery as a source of the secondary battery. Such a secondary battery has a characteristic that a capacity thereof deteriorates and decreases when charge and discharge are repeated many times and a useful life thereof is reduced when discharge is performed with a larger current. In general, even in the nickel-cadmium battery, which is said to have a long useful life with a large current, the number of times of repetition of charge and discharge is about 500 to 1000. If charge and discharge are repeated twenty times a day, the battery comes to the end of its life in about one month. Therefore, the secondary battery has a disadvantage that time and labor are required for replacement of the battery, and running cost such as cost for the battery to be replaced increases. Moreover, a lead-acid storage battery is not preferable as office equipment because, for example, the battery uses liquid sulfuric acid.

Consequently, for example, Japanese Patent Application Laid-Open Publication No. 2002-184554 discloses an image forming apparatus that uses a large-capacitance capacitor like an electric double layer capacitor as an auxiliary power supply for a fixing unit. Such an electric double layer capacitor has a characteristic that the number of times of repetition of charge and discharge is several tens thousand to several hundreds thousand, and a useful life depending on the number of times of charge and discharge is far longer than that of a battery.

However, when the auxiliary power supply is used, power must be charged in the auxiliary power supply. If a print operation is performed in a state in which sufficient power is not charged in the auxiliary power supply, charge in the auxiliary power supply is fully consumed in the midstream of the print operation. As a result, print speed falls from the midstream of the print operation, and if power of the auxiliary power supply runs short, an image with a poor fixing property is obtained unless fall in temperature in the heating roller is prevented by taking measures such as increasing an interval of print operations. On the other hand, it is preferable for a user that time until completion of an image forming job is shorter.

There is also a technique for changing a linear velocity or a sheet feeding time according to a state of a charging voltage at an auxiliary power supply. However, in any event, longer time is required until completion of a print operation compared with a case in which a fully charged auxiliary power supply is used.

SUMMARY OF THE INVENTION

It is an object of the present invention to solve at least the above problems in the conventional technology.

The image forming apparatus according to one aspect of the present invention includes a fixing unit that thermally fixes a toner image using a fixing member, where the fixing unit is heated by a heat generating member that generates heat by power supply from a chargeable auxiliary power supply; a power control unit that controls the power supply from the auxiliary power supply to the heat generating member based on a charging voltage of the auxiliary power supply; a job-turnaround-time predicting unit that predicts a job turnaround time required for executing an image forming job; a charging-time predicting unit that predicts a charging time for charging the auxiliary power supply to a predetermined charging voltage based on the charging voltage of the auxiliary power supply; and a control unit that controls a charging operation for the auxiliary power supply and execution of the image forming job based on the job turnaround time predicted and the charging time predicted, such that the job turnaround time for the image forming job is minimized.

The method of forming an image with a fixing unit that thermally fixes a toner image using a fixing member, where the fixing unit is heated by a heat generating member that generates heat by power supply from a chargeable auxiliary power supply, according to another aspect of the present invention includes steps of controlling the power supply from the auxiliary power supply to the heat generating member based on a charging voltage of the auxiliary power supply; predicting a job turnaround time required for executing an image forming job; predicting a charging time for charging the auxiliary power supply to a predetermined charging voltage based on the charging voltage of the auxiliary power supply; and controlling a charging operation for the auxiliary power supply and execution of the image forming job based on the job turnaround time predicted and the charging time predicted, such that the job turnaround time for the image forming job is minimized. The fixing unit that thermally fixes a toner image using a fixing member, where the fixing unit is heated by a heat generating member that generates heat by power supply from a chargeable auxiliary power supply, according to still another aspect of the present invention includes a power control unit that controls the power supply from the auxiliary power supply to the heat generating member based on a charging voltage of the auxiliary power supply; a job-turnaround-time predicting unit that predicts a job turnaround time required for executing an image forming job; a charging-time predicting unit that predicts a charging time for charging the auxiliary power supply to a predetermined charging voltage based on the charging voltage of the auxiliary power supply; and a control unit that controls a charging operation for the auxiliary power supply and execution of the image forming job based on the job turnaround time predicted and the charging time predicted, such that the job turnaround time, for the image forming job is minimized.

The other objects, features, and advantages of the present invention are specifically set forth in or will become apparent from the following detailed description of the invention when read in conjunction with the accompanying drawings.

DETAILED DESCRIPTION

Exemplary embodiments of an image forming apparatus, an image forming method, and a fixing unit according to the present invention will be explained in detail with reference to the accompanying drawings. In this specification, an "image forming job" indicates a photocopying job and a printing job.

Figure 1:
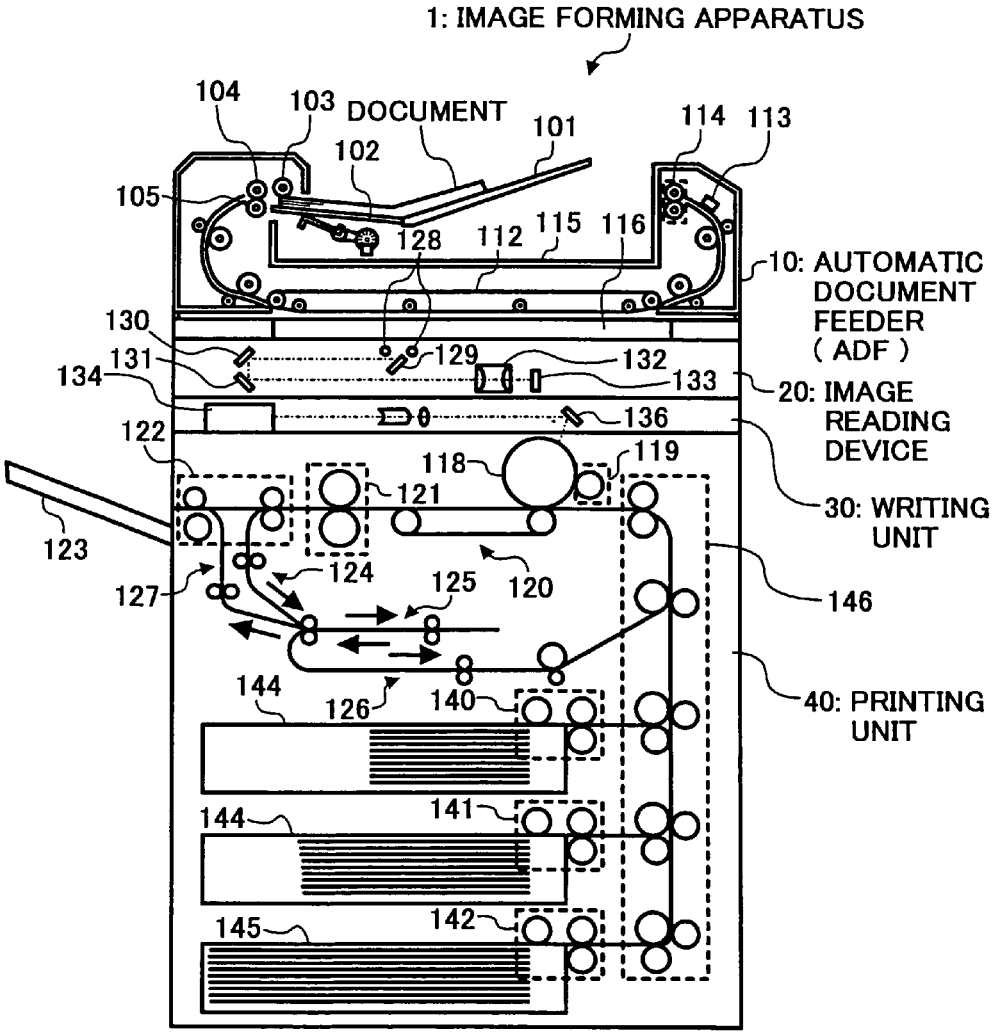
FIG. 1 is a schematic of an image forming apparatus to which the present invention is applied.

FIG. 1 is a schematic of an image forming apparatus to which the present invention is applied. An image forming apparatus 1 is, for example, a digital multifunction product, and has of a copying function, a printing function, and a facsimile function. The image forming apparatus 1 is made capable of sequentially switching and selecting the copying function, the printing function, and the facsimile function with an application switching key of an operation unit (see FIG. 2). Selection of the copying function, the printing function, and the facsimile function puts the image forming apparatus in a copier mode, a printer mode, and a facsimile mode, respectively.

The image forming apparatus 1 includes an automatic document feeder (ADF) 10 that automatically conveys a document to a document reading position, an image reader 20 that optically reads image information on the document conveyed to the document reading position, a writing unit 30 that writes the read image information of the document in a printer unit 40, and a printer unit 40 that forms a toner image of the image information on the document written by the writing unit 30, transfers the toner image onto a material to have an image transferred thereon like transfer paper, and discharges the material to have an image transferred thereon.

In the copier mode, in the ADF 10, when a start key on an operation unit 150 is depressed, a drawing-out roller 103, a sheet feeding roller 104, a separation roller 105, and a feeding belt 112 feed a document at the top of a document stack, which is formed by stacking documents on a sheet feeding tray 101 and a sheet feeding bottom plate 102 with image surfaces thereof facing upward, to a predetermined position on a contact glass 16.

The ADF 10 has a count function for counting up the number of documents every time feeding for one document is completed. The image reader 20 serving as image input means reads image information from the document on the contact glass 116. Then, the feeding belt 12 and a discharging roller 114 discharge the document onto a sheet discharge stand 115.

Similarly, the drawing-out roller 103, the sheet feeding roller 104, the separation roller 105, and the feeding belt 112 feed a second document (a document at the top now) on the sheet feeding tray 101 and the sheet feeding bottom plate 102 to the predetermined position on the contact glass 116. The image reader 20 reads image information from this document on the contact glass 116. Then, the feeding belt 112 and the discharging roller 114 discharge the document on the sheet discharge stand 115. A conveying motor (not shown) drives the drawing-out roller 103, the sheet feeding roller 104, the separation roller 105, the feeding belt 112, and the discharging roller 114.

A first sheet feeder 140, a second sheet feeder 141, and a third sheet feeder 142, which serve as sheet feeding means, feed sheets consisting of transfer paper serving as materials to have an image transferred thereon stacked on a first tray 143, a second tray 144, and a third tray 145, respectively, when the sheet feeders are selected. A vertical conveyance unit 146 conveys this transfer paper to a position where the transfer paper comes into abutment against a photosensitive body 118 serving as an image bearing body. For example, a photosensitive drum is used as the photosensitive body 118, which is driven to rotate by a main motor (not shown).

The writing unit 30 serving as writing means converts the image information on the document read by the image reader 20 into optical information via a not-shown image processing unit. A charger (not show) uniformly charges the photosensitive body 118. Then, the photosensitive body 118 is exposed to light according to the optical information from the writing unit 30, whereby an electrostatic latent image is formed on the photosensitive body 118. A developing device 119 develops the electrostatic latent image on the photosensitive body 18 to change the electrostatic latent image to a toner image.

A conveyor belt 120 serves as both sheet conveying means and transfer means. When a transfer bias is applied from a power supply, the conveyor belt 120 transfers the toner image on the photosensitive body 118 onto a transfer paper, which is conveyed from the vertical conveyance unit 146, while conveying the transfer paper at the same velocity as the photosensitive body 118. A fixing unit 121 fixes the toner image on this transfer paper, and a sheet discharging unit 122 discharges the transfer paper to a sheet discharge tray 123. After the toner image is transferred, a cleaning device (not shown) cleans the photosensitive body 118. The photosensitive body 118, the charger (not shown), the wiring unit 30, the developing device 119, and the conveyor belt 120 constitute an image forming unit that forms an image on a transfer paper according to image information.

The operations described above are operations at the time when an image is copied to one side of a sheet in a normal mode. However, when images are copied to both sides of a transfer paper in a duplex mode, the sheet discharging unit 122 switches the transfer paper, which is fed from any one of sheet feeding trays 143 to 145 and has the image formed on the surface thereof as described above, to a duplex paper receiving and conveying path 124 side rather than to the paper discharge tray 123. Then, a reversing unit 125 switches back to reverse the transfer paper, which is conveyed to a duplex conveyance unit 126.

The duplex conveyance unit 126 conveys the transfer paper, which is conveyed to this duplex conveyance unit 126, to a vertical conveyance unit 146. The vertical conveyance unit 146 conveys the transfer paper to a position where the transfer paper comes into abutment against the photosensitive body 118. Then, the toner image formed on the photosensitive body 118 as described above is transferred onto a back of the transfer paper and fixed by the fixing unit 121, whereby a duplex copy is obtained. The sheet discharging unit 122 discharges this duplex copy to the sheet discharge tray 123.

When the transfer paper is reversed and discharged, the sheet discharging unit 122 discharges the transfer paper, which is switched back and reversed by the reversing unit 125, to the sheet discharge tray 123 through a reversed sheet discharge and conveyance path 127 rather than conveying the transfer paper to the duplex conveyance unit 126.

In the printer mode, image information is inputted to the writing unit 30 instead of the image information from an image processing unit, and an image forming unit forms an image on a transfer paper. Moreover, in the facsimile mode, a not-shown facsimile transmission and reception unit sends image information from an image reading unit to a party on the other end, and the facsimile transmission and reception unit receives image information from the party on the other end. The image information is inputted to the writing unit 30 instead of the image information from the image processing unit, whereby the image forming unit forms an image on the transfer paper.

The image forming apparatus with the above-mentioned structure has a high-speed mode, in which the image forming apparatus executes a copy job (printer job) at high speed, and a low-speed mode, in which the image forming apparatus executes a copy job (printer job) at low speed. The numbers of revolutions of a drive motor necessary for conveying transfer paper, a main motor that drives the photosensitive body 118, a conveyance drive motor that conveys transfer paper, a drive motor for that rotates the fixing roller, a polygon motor that writes an electrostatic latent image in a photosensitive body, and the like are made variable. A not-shown control unit (see FIG. 6) changes the numbers of revolutions of these motors to execute the high-speed mode and the low-speed mode.

Figure 2:
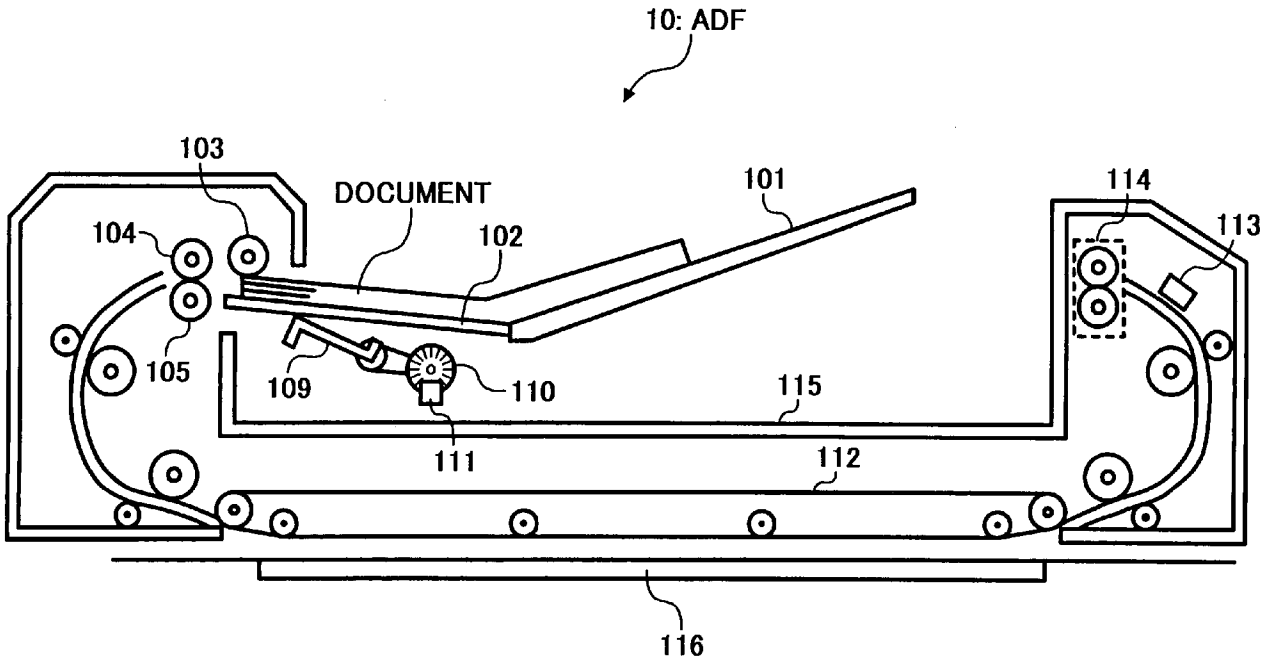
FIG. 2 is a schematic of an ADF shown in FIG. 1.
Figure 3:
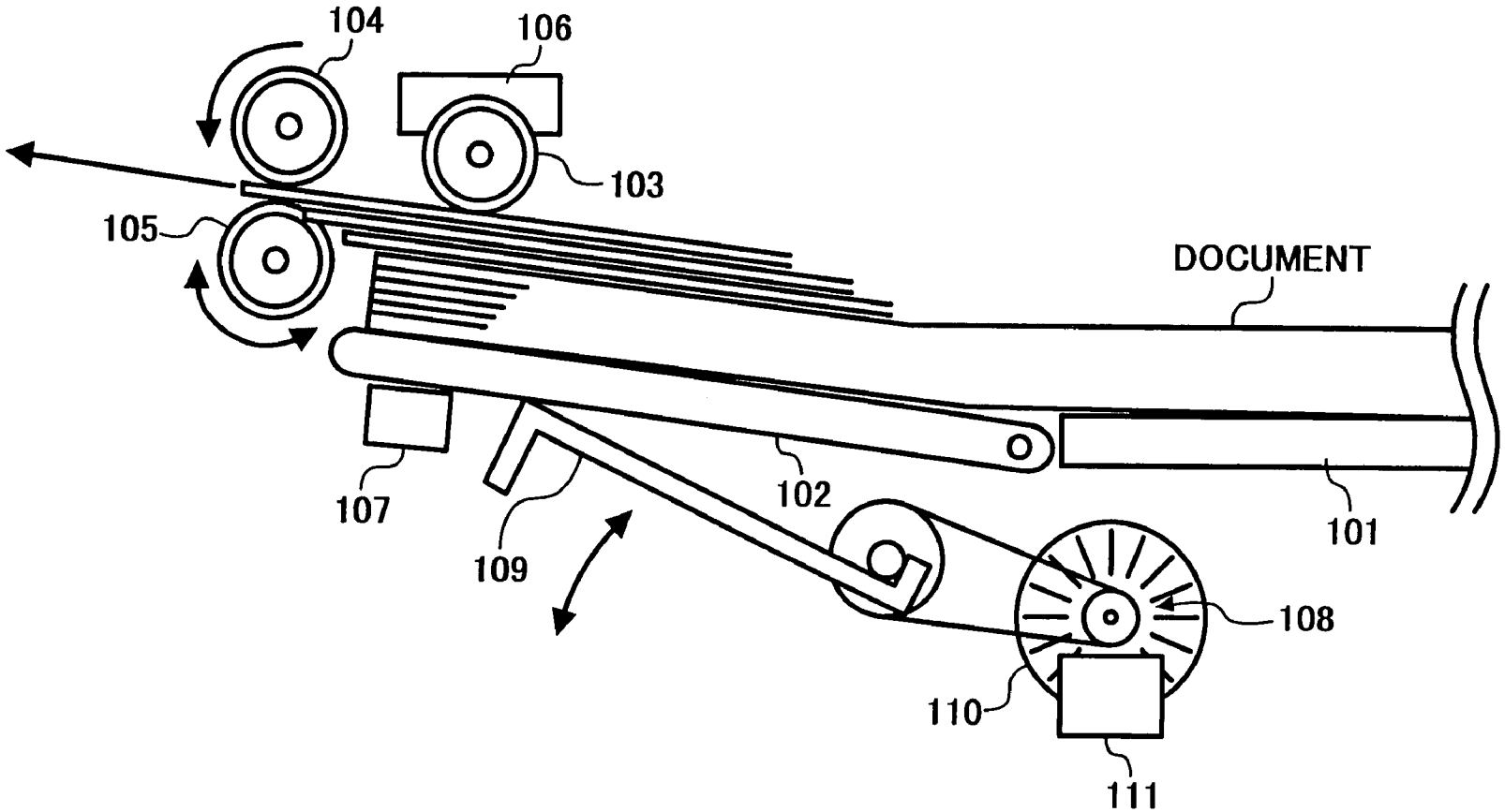
FIG. 3 is a schematic for illustrating a detailed mechanism around a sheet feeding tray and a sheet feeding bottom plate shown in FIG. 2.

FIG. 2 is a schematic of an ADF shown in FIG. 1. FIG. 3 is a schematic for explaining a mechanism for detecting the number of documents set in the ADF 10 in FIG. 2.

The ADF 10 includes a drawing-out roller home position sensor 106, a document set sensor 107, a bottom plate lifting motor 108, a bottom plate lifting motor 109, a slit encoder 110, and a slit sensor 111.

Figure 6:
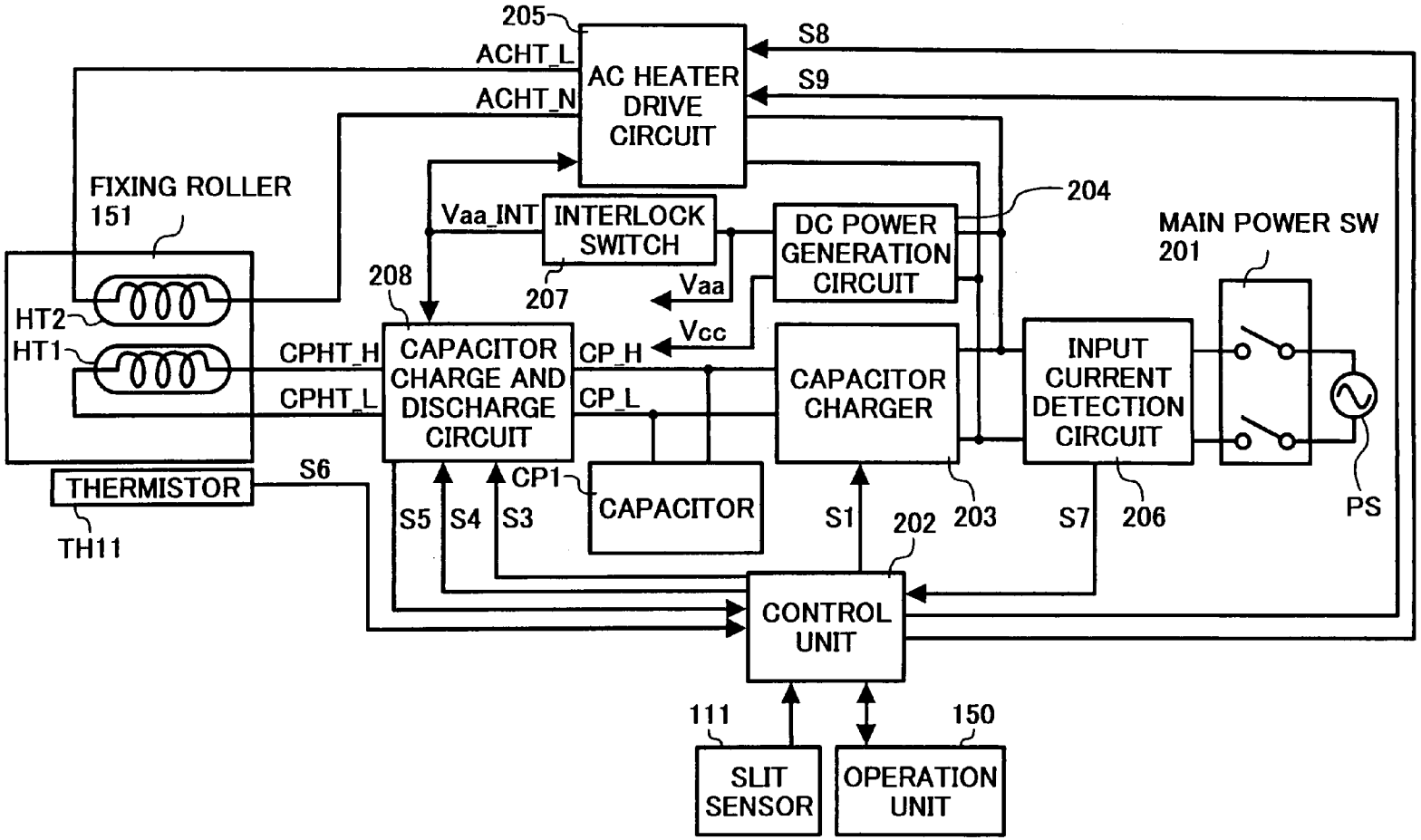
FIG. 6 is a schematic of a power control system for the fixing unit.

In the ADF 10, when a document is set on the sheet feeding tray 101 and the sheet feeding bottom plate 102, the document set sensor 107 detects the document (is turned ON) to output a detection signal to the control unit (see FIG. 6). In response to the detection signal, the control unit (see FIG. 6) rotates the bottom plate lifting motor 108 and lifts the sheet feeding bottom plate 102 together with the document using the bottom plate lifting lever 109 via a gear, a belt, or the like. Consequently, the drawing-out roller 103 for delivering the document to the sheet feeding roller 104 rises together with the document. Upon detecting the drawing-out roller 103, the drawing-out roller home position sensor 106 outputs a detection signal to the control unit (see FIG. 6). The control unit (see FIG. 6) stops the bottom plate lifting motor 108.

The slit encoder 110 is fixed to a rotation shaft of the bottom plate lifting motor 108 and rotates following rotation of the bottom plate lifting motor 108. The slit sensor 111 detects a rotation angle of the slit encoder 110 and outputs a detection signal to the control unit (see FIG. 6). This rotation angle of the slit encoder 110 is proportional to an amount of lifting of the bottom plate lifting lever 109. The control unit (see FIG. 6) assumes the number of documents set in the ADF 10 based upon the detection signal inputted from the slit encoder 110.

Figure 4:
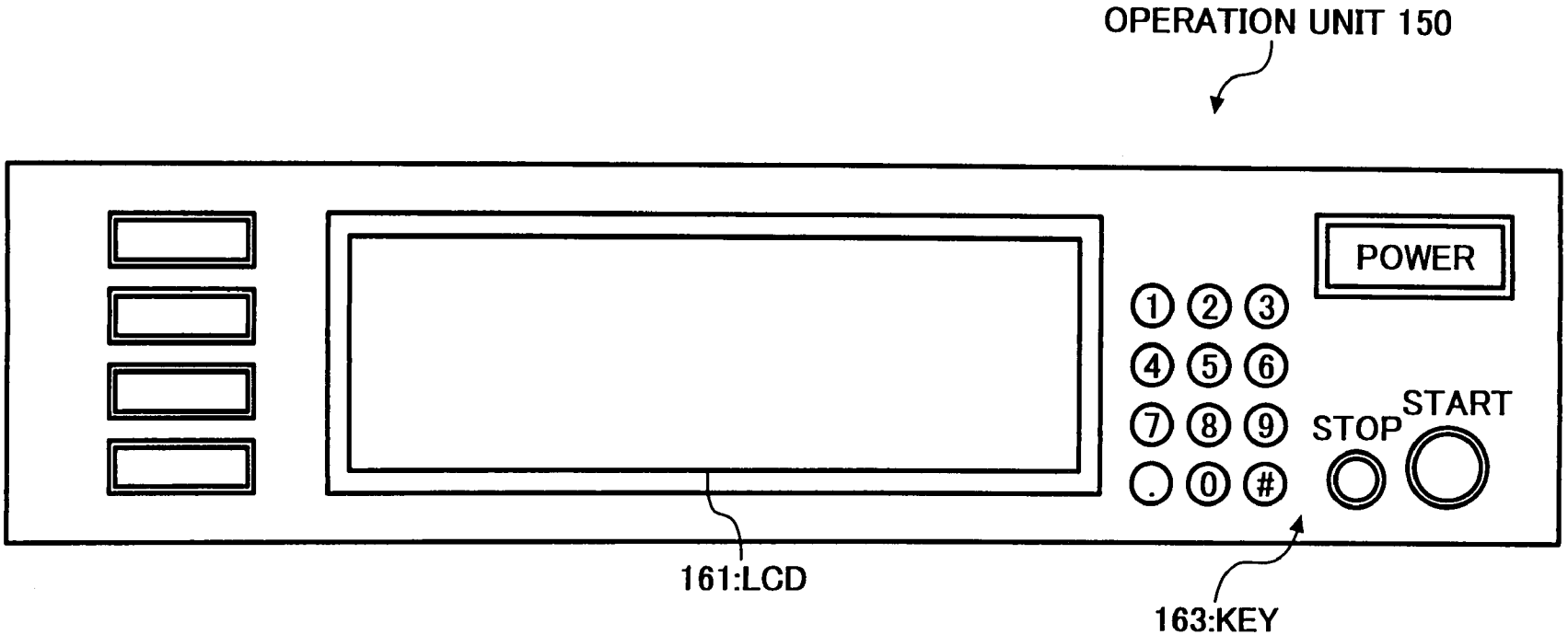
FIG. 4 is a schematic of an operation unit of the image forming apparatus.

FIG. 4 is a schematic of an operation unit of the image forming apparatus. The operation unit 150 is a unit for giving an instruction for execution of a copy job and the like to the control unit (see FIG. 6). As shown in FIG. 4, the operation unit 150 includes: an LCD 161 with a touch panel that displays necessary information and function keys; a KEY 163 including mechanical keys like a start key and a ten key; an LED; and the like.

Figure 5:
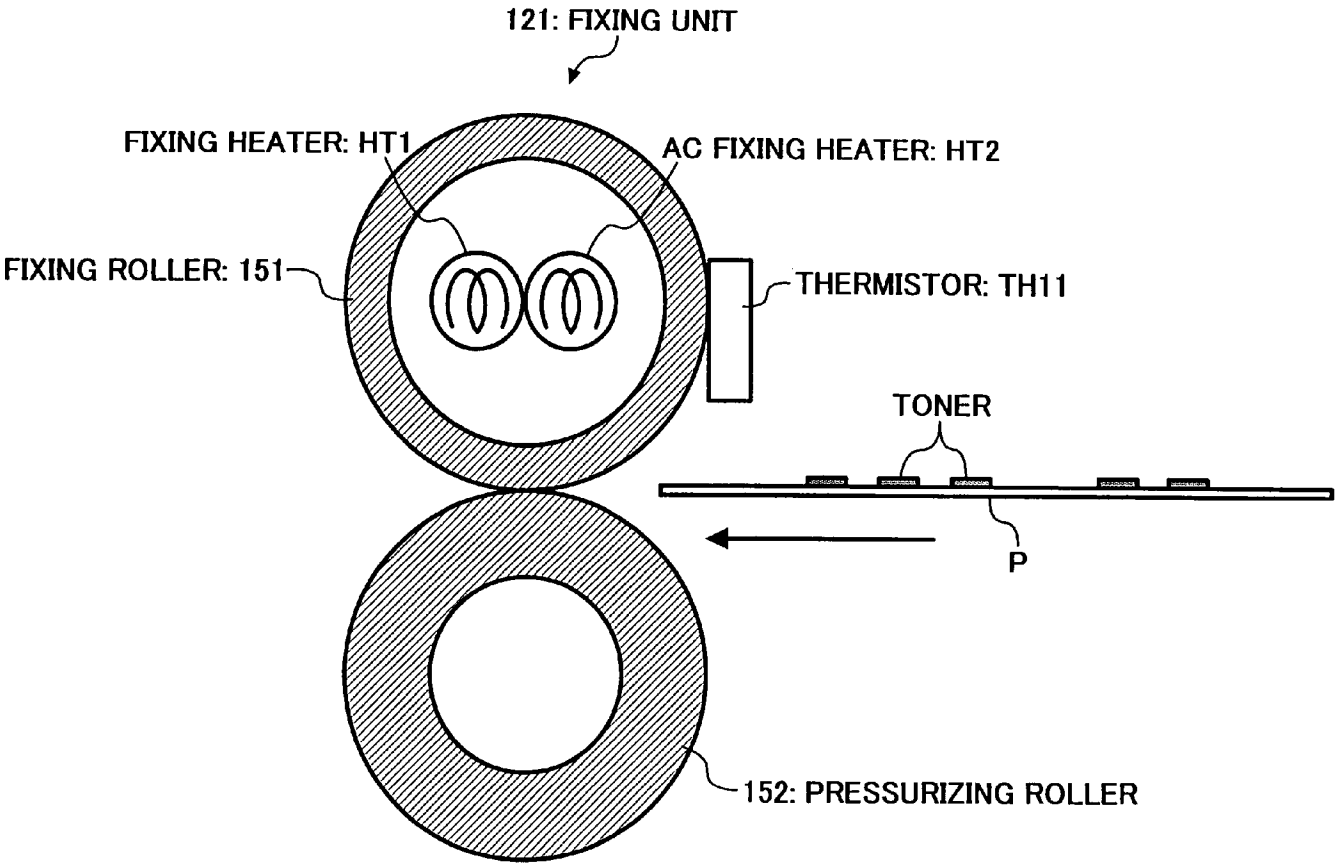
FIG. 5 is a schematic for illustrating an internal structure of a fixing unit shown in FIG. 1.

FIG. 5 is a schematic for illustrating an internal structure of a fixing unit shown in FIG. 1. The fixing unit 121 includes: a fixing roller 151 serving as a fixing member; a pressurizing roller 152 serving as a pressurizing member for pressurizing the fixing roller 151; an AC fixing heater HT2 serving as a main heating unit and a fixing heater HT1 serving as an auxiliary heating unit that are arranged inside the fixing roller 151 and heat the fixing roller 151 from the inside thereof; and a thermistor TH11 serving as temperature detecting means that is in abutment against the surface of the fixing roller 151 and detects a surface temperature (fixing temperature) of the fixing roller 151.

The fixing roller 151 consists of an elastic member like silicon rubber and thermally fixes a toner image transferred onto transfer paper. The pressurizing roller 152 consists of an elastic member like silicon rubber and is pressed against the fixing roller 151 at a fixed pressurizing force by a not-shown pressurizing unit. In general, a halogen heater is used for the fixing heater HT1 and the AC fixing heater HT2. However, other resistors may be used. The AC fixing heater HT2 generates heat (turns on) when AC power is supplied from an AC heater drive circuit (see FIG. 7), and the fixing heater HT1 generates heat (turns on) when a voltage is supplied from a capacitor (see FIG. 6) serving as an auxiliary power supply.

In the fixing unit 121 with the above-mentioned structure, the fixing roller 151 and the pressurizing roller 152 are driven to rotate by a not-shown driving mechanism. A toner carried on a sheet P such as transfer paper is fixed on the sheet P according to heating and pressurization by the fixing roller 151 and the pressurizing roller 152 when the sheet P passes through a nip section between the fixing roller 151 and the pressurizing roller 152.

Note that, in this context, the fixing member and the pressurizing member are generally rollers as shown in FIG. 5 but are not limited to the rollers. An endless belt or the like may be used for one or both of the fixing member and the pressurizing member. In addition, the fixing heater HT1 and the AC fixing heater HT2 are arranged inside the fixing roller 151. However, the fixing heater HT1 and the AC fixing heater HT2 may be arranged in any position as long as the fixing heater HT1 and the AC fixing heater HT2 are capable of heating the fixing roller 151.

FIG. 6 is a schematic of a power control system for the fixing unit. The power control system for the fixing unit includes a main power SW 201 that turns ON/OFF supply of AC power, a control unit 202 that controls respective units of the image forming apparatus and a power supply circuit 200, a capacitor charger 203 that charges a capacitor CP, a DC power generation circuit 204 that generates DC power of the image forming apparatus; an AC heater drive circuit 205 that supplies AC power to the AC fixing heater HT2, an input current detection circuit 206 that detects an input current inputted from an AC power supply; an interlock switch 207, a capacitor charge and discharge circuit 208 that discharges the capacitor CP1 and supplies DC power to the fixing heater HT1, and a capacitor CP1 serving as an auxiliary power supply for the fixing heater HT1.

The AC power supply supplies AC power to the AC heater drive circuit 205, the DC power generation circuit 205, and the capacitor charger 203 via the main power SW 201 and the input current detection circuit 206.

The control unit 202 is a unit for controlling the respective units of the power supply circuit 200. The control unit 202 controls operations of the capacitor charger 203, the AC heater drive circuit 205, and the capacitor charge and discharge circuit 208. More specifically, the control unit 202 sends a control signal S1 to the capacitor charger 203 to control an operation for charging the capacitor CP1 by the capacitor charger 203. In addition, the control unit 202 sends control signals S3 and S4 to the capacitor charge and discharge circuit 208 to control an operation for turning ON/OFF the fixing heater HT1 by the capacitor charge and discharge circuit 208. Further, the control unit 202 sends control signals S8 and S9 to the AC heater drive circuit 208 to control an operation for turning ON/OFF the fixing heater HT2 by the AC heater drive circuit 205. Moreover, the control unit 202 estimates the number of documents set in the ADF 10 based on a detection signal inputted from the slit sensor 111 and predicts a turnaround time for a copy job for each of the operation modes (the high-speed mode and the low-speed mode) based on the estimated number of documents, the number set by the operation unit 150, and a time necessary for printing one sheet in each of the operation modes.

The input current detection circuit 206 is provided among the main power SW 201, the AC heater drive circuit 205, the DC power generation circuit 204, and the capacitor charger 202. The input current detection circuit 206 detects an input current of AC power inputted via the main power SW 201, and outputs a detection current S7 to the control unit 202. This input current fluctuates according to operation states of the AC heater drive circuit 205, the DC power generation circuit 204, the capacitor charger 202, and the image forming apparatus.

The DC power generation circuit 204 generates power Vcc, which is used mainly in a control system inside the image forming apparatus, and power Vaa, which is used mainly in a drive system and a medium/high voltage power supply, base on the AC power inputted via the main power SW 201, and outputs the power Vcc and the power Vaa to the respective units.

The interlock switch 207 is a switch to be turned ON/OFF in association with not-shown covers of the image forming apparatus. When the image forming apparatus has a drive member or a medium/high voltage application member that can be touched by the covers when the covers are opened, the interlock switch 207 interrupts a power supply such that an operation of the drive member or application of a voltage to the application member is stopped when the covers are opened. A part of the power Vaa generated by the DC power generation circuit 204 is inputted to the interlock switch 207 and is inputted to the capacitor charge and discharge circuit 208 and the AC heater drive circuit 205 via this interlock switch 207.

The AC heater drive circuit 205 turns ON/OFF the AC fixing heater HT2 according to the control signals S8 and S9 inputted from the control unit 202.

The capacitor charger 203 is connected to the capacitor CP1 and charges the capacitor CP1 based on the control signal S1 inputted from the control unit 202.

The capacitor CP1 is constituted by a large-capacitance capacitor such as the electric double layer capacitor. The capacitor CP1 is connected to the capacitor charger 203 and the capacitor charge and discharge circuit 208 and charged by the capacitor charger 203. Charged power of the capacitor CP1 is supplied to the fixing heater HT1 according to ON/OFF control by the capacitor charge and discharge circuit 208.

The capacitor charge and discharge circuit 208 discharges the power accumulated in the capacitor CP1 according to the control signals S3 and S4 inputted from the control unit 202 and turns ON/OFF the fixing heater HT1.

The thermistor TH11 is provided near the fixing roller 151 and outputs a detection signal S6 corresponding to a surface temperature of the fixing roller S151 to the control unit 202. Since a resistance of the thermistor TH11 changes according to temperature, the control unit 202 utilizes temperature change in the resistance to detect the surface temperature of the fixing roller 151 based on the detection signal S6.

Figure 7:
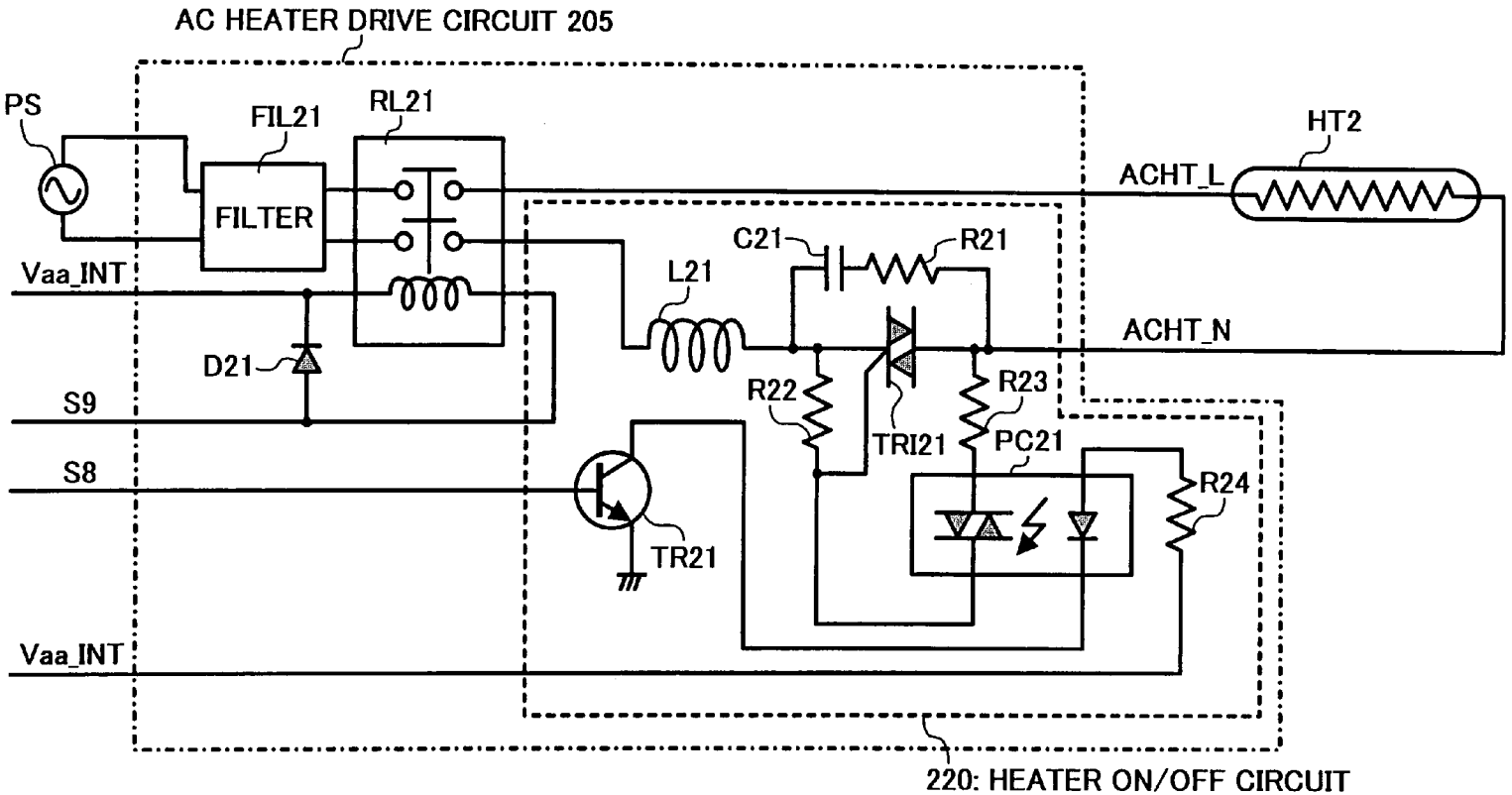
FIG. 7 is a schematic of an AC heater drive circuit shown in FIG. 6.

FIG. 7 is a schematic of the AC heater drive circuit 205 shown in FIG. 6. The AC heater drive circuit 205 includes a filter FIL21 that removes noise of AC power to be inputted, a fixing relay for safety RL21 that is turned ON/OFF according to the control signal S9 inputted from the control unit 202, a diode D21 for preventing counter-electromotive force in the fixing relay for safety RL21, and a heater ON/OFF circuit 220 that turns ON/OFF the AC fixing heater HT2 based on the control signal S8 inputted from the control unit 202.

The AC power supply is connected to one end side of the fixing heater HT2 via the filter FIL21 and the fixing relay for safety RL21. The other end side of the fixing heater HT2 is connected to the heater ON/OFF circuit 220.

The heater ON/OFF circuit 220 includes a triac TRI21 for turning ON/OFF the AC power supply, a photocoupler PC21 for turning ON a gate of the triac TRI21 and insulating a signal from the control unit 202 that is a secondary side, a transistor TR21 for driving a light-emitting side LED of the photocoupler PC21, a noise absorbing snubber circuit including a capacitor CP1 and a resistor R21; a noise absorbing inductor L21, a resistor R22 serving a dynamic current prevention resistor, and resistors R23 and R24 serving as current limiting resistors for the photocoupler PC 21.

In the AC heater drive circuit 205 with the above-mentioned structure, the AC fixing heater HT2 turns on when power is supplied in a state in which both the fixing relay for safety RL21 and a gate of the transistor TR21 are turned ON.

In a state in which the control signal S9 to be supplied to the fixing relay for safety RL21 is turned ON, the control unit 202 turns ON/OFF the control signal S8 to be supplied to the gate of the transistor TR21 of the heater ON/OFF circuit 220 to control turning on/off of the AC fixing heater HT2.

Figure 8:
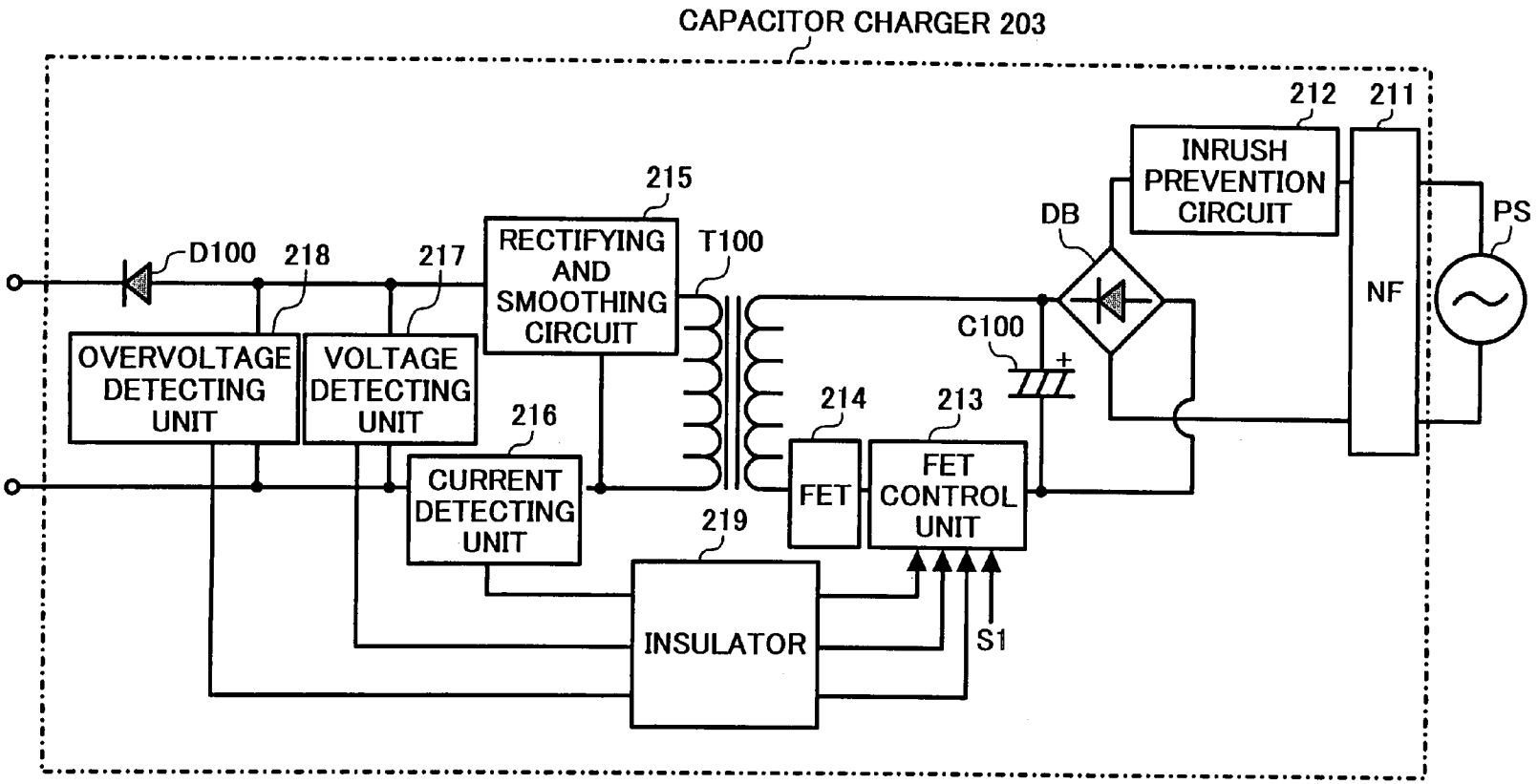
FIG. 8 is a schematic of a capacitor charger shown in FIG. 6.

FIG. 8 is a schematic of the capacitor charger 203 shown in FIG. 6. The capacitor charger 203 includes a noise filter (NF) 211 that removes noise of an AC voltage to be inputted, an inrush prevention circuit 212 for preventing an inrush current, a diode bridge DB that rectifies AC power PS to be inputted via the inrush prevention circuit 212, a capacitor CP100 that smoothes the rectified AC voltage, an FET control unit 213 that controls switching of an FET 214 to control a charging operation of the capacitor CP1 (see FIG. 6), an FET 214 that turns ON/OFF a transformer T100; a transformer T100 that boosts an input voltage, a rectifying and smoothing circuit 215 that rectifies and smoothes an output on a secondary side of the transformer T100 to convert the output into a DC output, a constant current detection unit 126 that detects a current, a constant voltage detection unit 217 that detects a voltage, an overvoltage detection unit 218 that detects an overvoltage to prevent the overvoltage from being applied to the capacitor CP1, a diode D100 for preventing a reverse current from the capacitor CP1, and an insulator 219.

An AC voltage inputted from the AC power supply PS is rectified by the diode bridge DB via the inrush current prevention circuit after noise is removed from the AC voltage by the noise filter NF. A DC voltage obtained by smoothing the AC voltage with the capacitor CP1 is inputted to a primary side of the transformer T100. The FET control unit 213 starts switching control for the FET 214 to charge the capacitor CP1 when the control signal A1 inputted from the control unit 202 (see FIG. 5) is turned ON. The FET control unit 203 subjects the FET 214 to switching control based on respective detection signals inputted from the current detection unit 216, the voltage detection unit 217, and the overvoltage detection unit 218 to perform constant current control, constant voltage control, or constant power control for charging the capacitor CP1. In general, it is desirable to charge the capacitor CP1 at a constant current. However, a charging time can be reduced by charging the capacitor CP1 according to the constant power control.

The transformer T100 is turned ON/OFF by the FET 214 to boost a primary side input thereof and outputs the input from the secondary side. The rectifying and smoothing circuit 215 rectifies and smoothes the secondary side output of the transformer T100, and the secondary side output is outputted to the capacitor CP1 via the diode D100. The current detection unit 216, the voltage detection unit 217, and the overvoltage detection unit 218 detects a current, a voltage, and an overvoltage at the secondary side output of the transformer T100 after the rectification and smoothing. Respective detection signals of the current, the voltage, and the overvoltage are inputted to the FET control unit 213.

Figure 9:
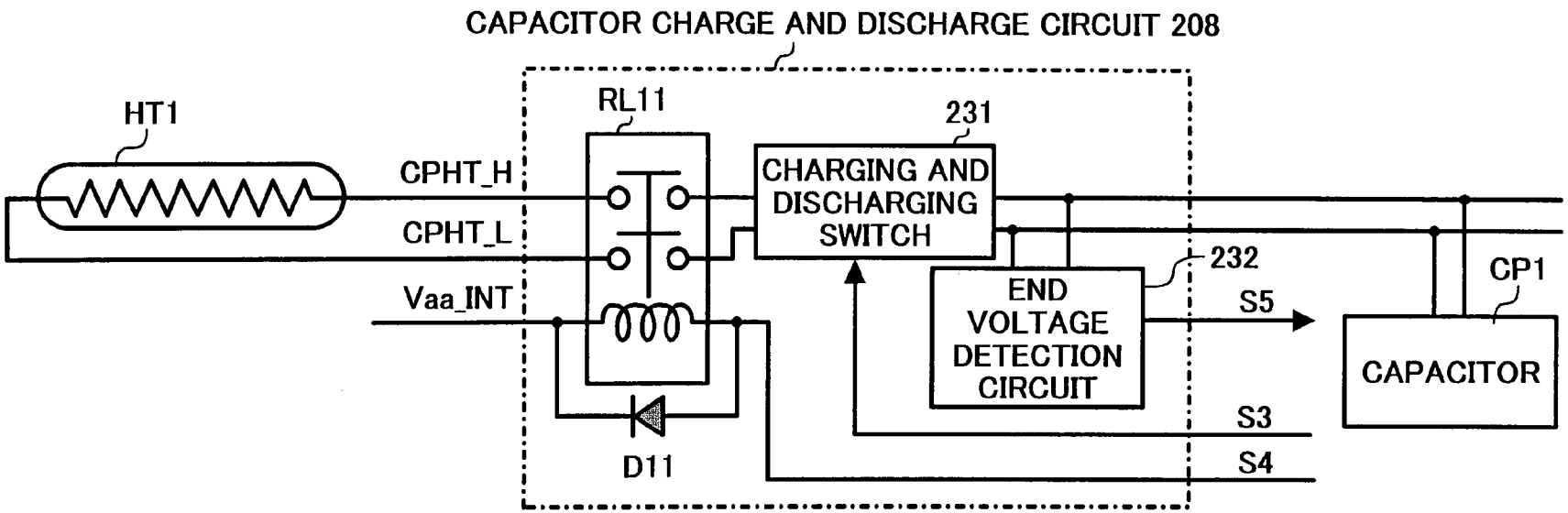
FIG. 9 is a schematic of a capacitor charge and discharge circuit shown in FIG. 6.

FIG. 9 is a schematic of the capacitor charge and discharge circuit 208 shown in FIG. 6. The capacitor charge and discharge circuit 208 includes: a charging and discharging switch 231; a fixing relay for safety RL11; a diode D11 for preventing counter-electromotive force in the fixing relay RL11; and a both-end voltage detection circuit 232 that detects a voltage across the capacitor CP1.

The charging and discharging switch 231 and the fixing relay for safety RL11 are connected to both the ends of the capacitor CP1. The charging and discharging switch 231 is turned ON/OFF according to the control signal S3 inputted from the control unit 202. Similarly, the fixing relay for safety RL11 is turned ON/OFF according to the control signal S4 inputted from the control unit 202.

When both the charging and discharging switch 231 and the fixing relay for safety RL11 are turned ON, charge accumulated in the capacitor CP1 is discharged, and power is supplied to the fixing heater HT1.

The both-end voltage detection circuit 232 detects a voltage across the capacitor CP1 and outputs a voltage signal S5 of the voltage to the control unit 202. The control unit 202 always monitors this voltage signal S5 to monitor a charging state of the capacitor CP1.

Figure 10:
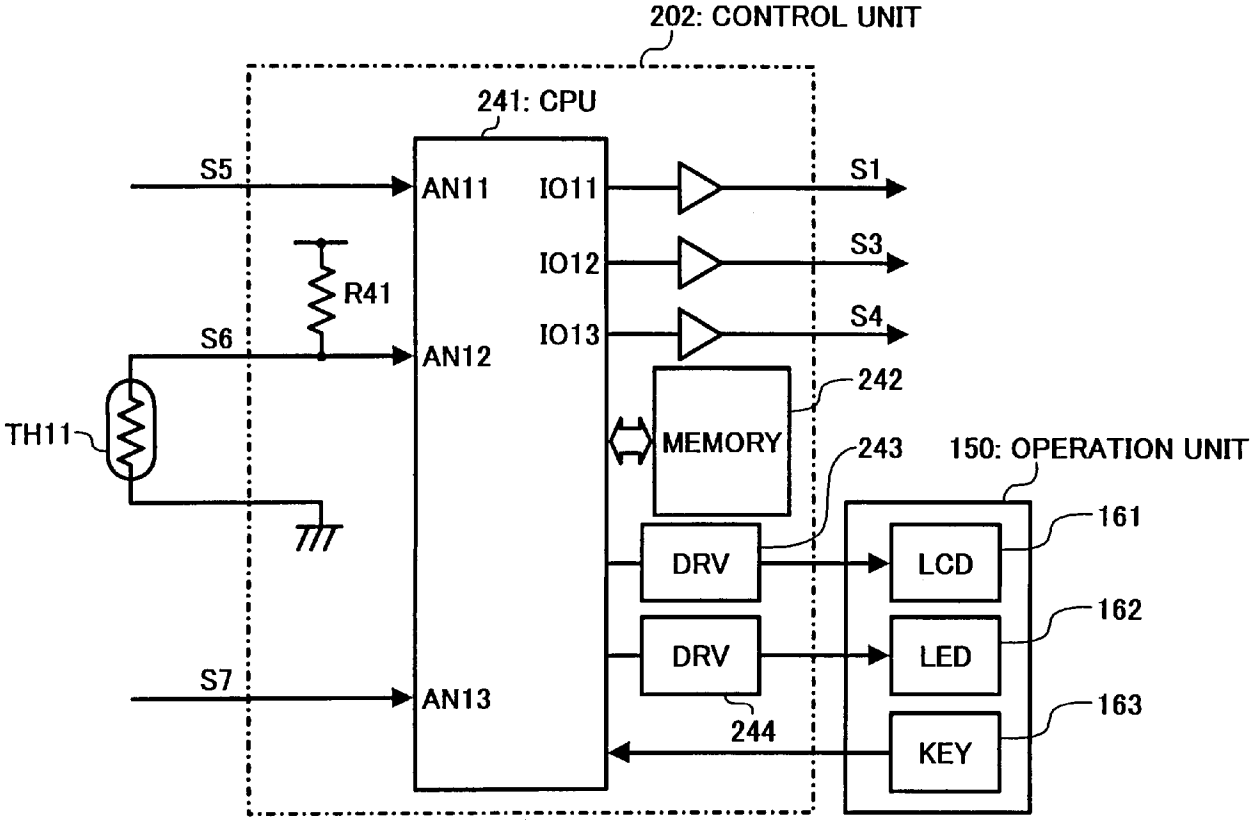
FIG. 10 is a schematic of a control unit shown in FIG. 6.

FIG. 10 is a schematic of the control unit 202 shown in FIG. 6. The control unit 202 includes a CPU 241, a memory 242, and the like.

The CPU 241 is connected to a memory 242 for storing programs and data for controlling the image forming apparatus and controls the image forming apparatus and the power supply circuit 200 based on the programs stored in the memory 242.

The voltage signal (analog signal) S5 that represents the voltage across the capacitor CP1 detected by the both-end voltage detection circuit 232 of the capacitor charge and discharge circuit 208, the detection signal (analog signal) S6 that is divided according to resistances of the thermistor TH11 for detecting a surface temperature of the fixing roller 151 and the resistor R41, and the detection current (analog signal) S7 that is obtained by detecting an input current of the image forming apparatus in the input current detection circuit 206, and the like are inputted to the CPU 241.

The CPU 241 outputs, via an IO port, the control signal S1 for turning ON/OFF charging for the capacitor CP1, the control signal S3 for turning ON/OF the charging and discharging switch 231, the control signal S4 for turning ON/OFF the fixing relay for safety RL11, the control signal S8 for turning ON/OFF the heat ON/OFF circuit 220, the control signal s9 for turning ON/OFF the fixing relay for safety R21, and the like.

In addition, the CPU 241 is constituted to control the operation unit 150 and monitors an input of the KEY 163 provided on the operation unit 150. A DRV 243 is a driver that drives an LCD 11, and a DRV 244 is a driver that drives an LED 162. The CPU 241 controls and drives the DRV 243 and the DRV 244.

Figure 11:
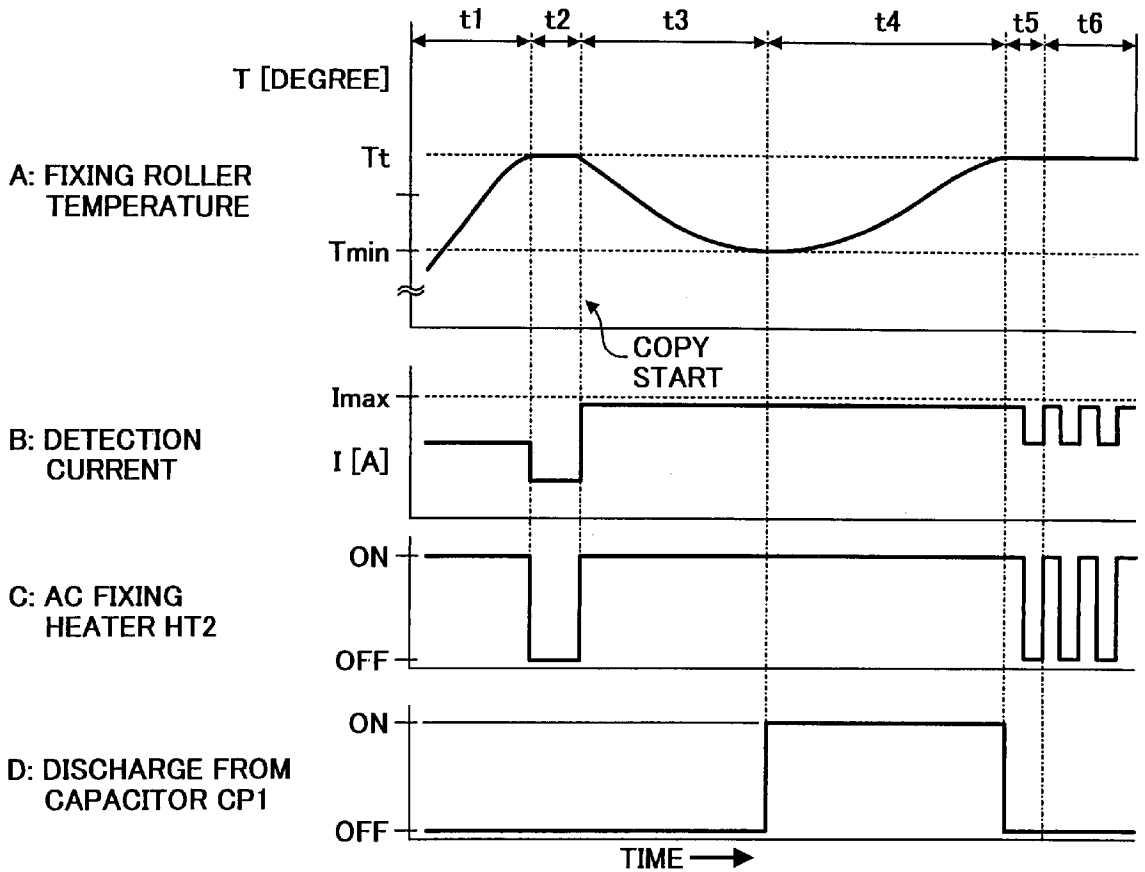
FIG. 11 is a timing chart for explaining temperature control of a fixing roller.

FIG. 11 is a timing chart for explaining temperature control of the fixing roller 151: (a) shows a surface temperature T of the fixing roller 151; (b) shows a detection current (input current) I detected by the input current detection circuit 206; (c) shows timing of ON/OFF of the AC fixing heater HT2; and (d) shows timing of ON/OFF of the fixing heater HT1.

A period t1 indicates a warm-up period of the image forming apparatus (fixing roller 151), a period t2 indicates a standby period of the image forming apparatus, and periods t3 to t6 indicate periods after a copy operation is started.

In the period t1, the control unit 202 raises a surface temperature of the fixing roller 151 to a predetermined temperature Tt. Usually, the control unit 202 supplies power to the AC fixing heater HT2 serving as a heat generating member from an AC power supply to heat the fixing roller 151 as shown in (a). In this period t1, although the AC fixing heater HT2 is at full duty, since a copy operation is not performed, the input current I is equal to or less than a maximum input current Imax as shown in (b).

When the surface temperature of the fixing roller 151 detected by the thermistor TH11 reaches a target temperature Tt that is temperature allowing a copy operation, the control unit 202 stops power supply to the AC fixing heater HT2, the warm-up period t1 ends, and the image forming apparatus shifts to a copy standby state (t2 period).

In the period t2, the control unit 202 turns ON the AC fixing heater HT2 when the surface temperature of the fixing roller 151 falls to be lower than the target temperature Tt and turns OFF the AC fixing heater HT2 when the surface temperature reaches the target temperature Tt while monitoring the surface temperature. The control unit 202 repeats the turning ON/OFF of the AC fixing heater HT2. In the period t2, even if the surface temperature of the fixing roller 151 has reached the target temperature Tt, when a copy operation is started in a state in which the periphery of the fixing unit 121 is not warmed sufficiently, as in the period t3, the surface temperature of the fixing roller 151 may fall immediately after the copy operation is started even in a state in which the AC fixing heater HT2 is on. Actually, a copy operation is possible even if the surface temperature of the fixing roller 151 falls to be lower than the target temperature Tt. However, since a fixing property cannot be secured if the surface temperature of the fixing roller 151 falls to be lower than Tmin, the copy operation has to be stopped.

During the copy operation in the period t3, it is likely that the input current I of the DC power generation circuit 204 increases following an increase in a load current on a DC power supply side, and as shown in (b), an input current of the entire apparatus also increases, power consumption of the entire apparatus also increases, and the input current I reaches the maximum input current Imax. The input current I should not exceed this maximum input current Imax from a viewpoint of apparatus specifications. Thus, in the period t3, a turning-on rate of the AC fixing heater HT2 cannot be further increased as shown in (c). Therefore, as in the period t4, the control unit 202 discharges and supplies power charged in the capacitor (CP1) in advance to the fixing heater HT1, which is provided separately from the AC fixing heater HT2, to thereby raise the surface temperature of the fixing roller 151 such that the surface temperature of the fixing roller 151 does not fall to be lower than Tmin.

In period t4, as in the period t2, the control unit 202 discharges the capacitor CP1 as shown in FIG. 11D to supply power to the fixing heater HT1. When the surface temperature of the fixing roller 151 reaches the target temperature Tt as shown in (a), the control unit 202 stops the discharge.

In the period t5, even if the discharge and supply of power from the capacitor CP1 is stopped, when the surface temperature of the fixing roller 151 can be maintained at the target temperature Tt only by the AC fixing heater HT2 as in the period t6, the control unit 202 controls ON/OFF of the AC fixing heater HT2 to thereby perform temperature control for the fixing roller 151.

Figure 12:
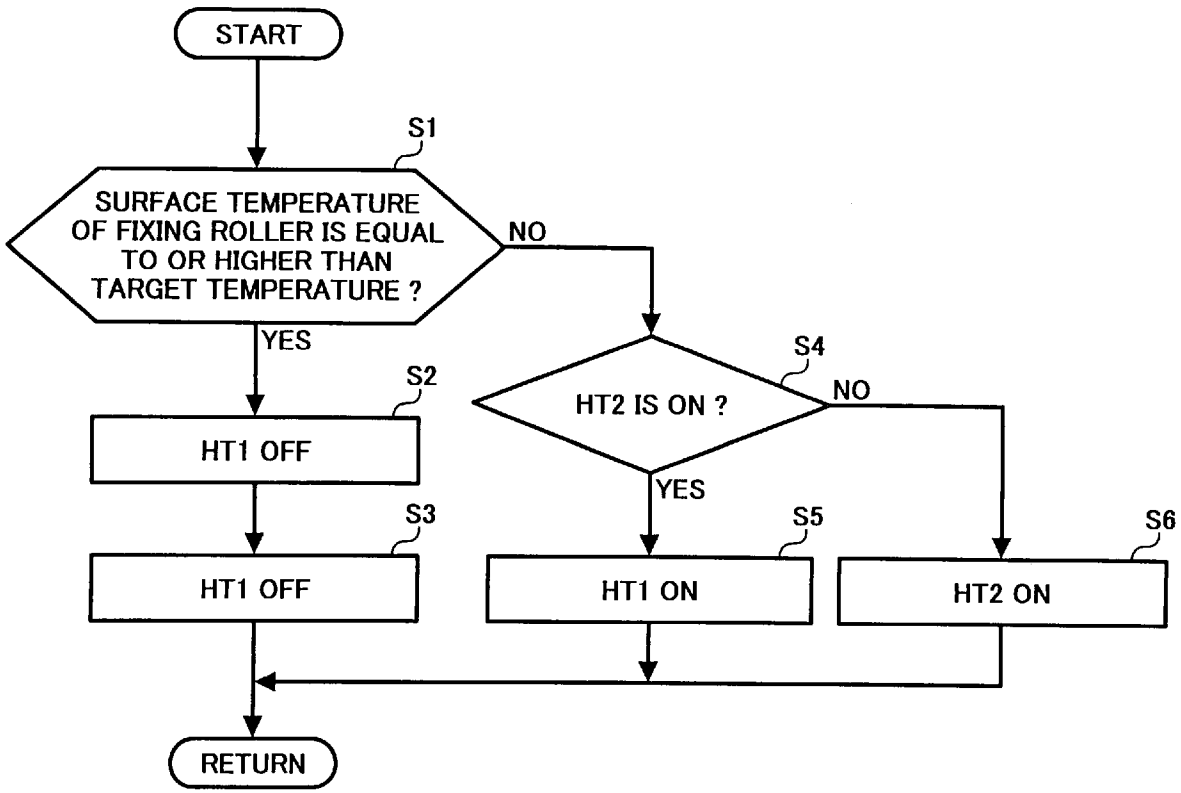
FIG. 12 is a flowchart of a process procedure for ON/OFF control of a fixing heater.

FIG. 12 is a flowchart of a process procedure for ON/OFF control for the fixing heater HT1 and the AC fixing heater HT2. The ON/OFF control for the fixing heater TH1 and the AC fixing heater TH2 by the control unit 202 will be described with reference to FIG. 12.

The control unit 202 detects a surface temperature of the fixing roller 151 according to the detection signal S6 inputted from the temperature detection thermistor TH11 and judges whether the surface temperature of the fixing roller 151 is equal to or higher than the target temperature Tt (step S1). As a result of this judgment, if the surface temperature of the fixing roller 151 is equal to or higher than the target temperature Tt ("Yes" in step S1), the control unit 202 turns OFF the control signals S3 and S4, which are outputted to the capacitor charge and discharge circuit 208, to turn OFF the fixing heater HT1 (step S2), and turns OFF the control signals S8 and S9, which are outputted to the AC heater drive circuit 205, to turn OFF the AC fixing heater HT2 (step S3).

On the other hand, if the surface temperature of the fixing roller 151 is not equal to or higher than the target temperature Tt ("No" in step S1), first, the control unit 202 judges whether the AC fixing heater HT2 is ON (step S4). As a result of this judgment, if the AC fixing heater HT2 is not ON ("No" in step S4), the control unit 202 turns ON the control signals S8 and S9, which are outputted to the AC heater drive circuit 205, to turn ON the AC fixing heater HT2 and control the AC fixing heater HT2 such that the surface temperature of the fixing roller 151 reaches the target temperature Tt (step S6). In addition, if the AC fixing heater HT2 is ON ("Yes" in step S4), the control unit 202 turns ON the control signals S8 and S9, which are outputted to the capacitor charge and discharge circuit 208, to turn ON the fixing heater HT1 before the surface temperature of the fixing roller 151 falls to be lower than Tmin (step S5).

A method of reducing a copy job time will be described with reference to FIG. 13. As described above, the control unit 202 assumes the number of documents set in the ADF 10 based on a detection signal for the slit encoder 110 to be inputted from the slit sensor 111.

The control unit 202 calculates a copy time (job completing time) T1 in the respective operation modes (the high-speed mode and the low-speed mode) based on the estimated number of documents and the number set by the operation unit 150. A time required for printing one sheet in the respective modes (the high-speed mode and the low-speed mode) varies depending upon a size of transfer paper, a type of transfer paper (thickness of transfer paper such as thick paper or plain paper, etc.), selection of enlargement/reduction printing, setting of simplex/duplex printing or the like, a time period in which printing is performed, temperature of a fixing roller (high-speed printing is impossible at the time of low temperature), and the like.

The control unit calculates (predicts) a job completing time in the high-speed mode (time for completing a job at high speed) T1HIGH and a job completing time in the low-speed mode (time for completing a job at high speed) T1LOW according to following expressions (1) and (2), respectively.

$$T1\text{HIGH}=T2\text{HIGH}+\{(nd\times ns)-1\}\times T3\text{HIGH} \quad (1)$$

$$T1\text{LOW}=T2\text{LOW}+\{(nd\times ns)-1\}\times T3\text{LOW} \quad (2)$$

where, nd is number of documents, ns is set number of sheets, T2HIGH is a first copy time in the high-speed mode, T3HIGH is a time required for printing per one sheet in the high-speed mode, T2LOW is a first copy time in the low-speed mode, and T3LOW is a time required for printing per one sheet in the low-speed mode.

In the expressions (1) and (2), in a first copy (copy of a first sheet), a time for reading a document and a time until first transfer paper is fed are required, and a turnaround time is different from that in copying second and subsequent sheets. Thus, the job completing time is calculated by adding a copy time for the second and subsequent sheets {(nd×ns) −1}×T3 to a first copy time T2.

The control unit 202 calculates (predicts) a charging time that is required when the capacitor charger 203 charges the capacitor CP1. Following expression (3) represents an example of an expression for calculating a charging time Tc that is required when the capacitor charger 203 charges the capacitor CP1 at a constant current $$Tc=Cx(V1-V2)/I \text{ [second]} \quad (3)$$

where, Tc is a charging time, C is an electrostatic capacitance of the capacitor, V2 is a target charging voltage, V2 is a present charging voltage, and I is a charging current.

Following expression (4) represents an example of an expression for calculating the charging time Tc that is required when the capacitor charger 203 charges the capacitor CP1 at constant power $$Tc=Cx(V_h{}2-V_i{}2)/2W \text{ [second]} \quad (4)$$

where, Tc is a charging time, C is an electrostatic capacitance of the capacitor, Vh is charging completion power, Vi is a charging start voltage, and W is charging power.

When the operation unit 150 instructs execution of a copy job, the control unit 202 calculates job completing times for the copy job in the high-speed mode and the low-speed mode, and calculates a charging time required for charging the capacitor CP1 to a target charging voltage. Then, the control unit 202 controls an operation for charging the capacitor CP1 and an operation for executing the copy job based on the calculated job completing times for the copy job in the high-speed mode and the low-speed mode and the calculated charging time for the capacitor CP1 such that a turnaround time of the copy job is reduced.

Here, the explanation is on the premise that printing in the low-speed mode (e.g., 25 cpm (copy/min)) is possible even if the capacitor CP1 is not charged sufficiently, and printing in the high-speed mode (e.g., 50 cpm (copy/min)) is impossible unless the capacitor CP1 is charged sufficiently. In addition, it is considered that, as an example, the capacitor CP1 is in a fully charged state when a charging voltage is 44 volts, and a threshold charging voltage decided in advance (target charging voltage) is 32 volts.

Figure 13:
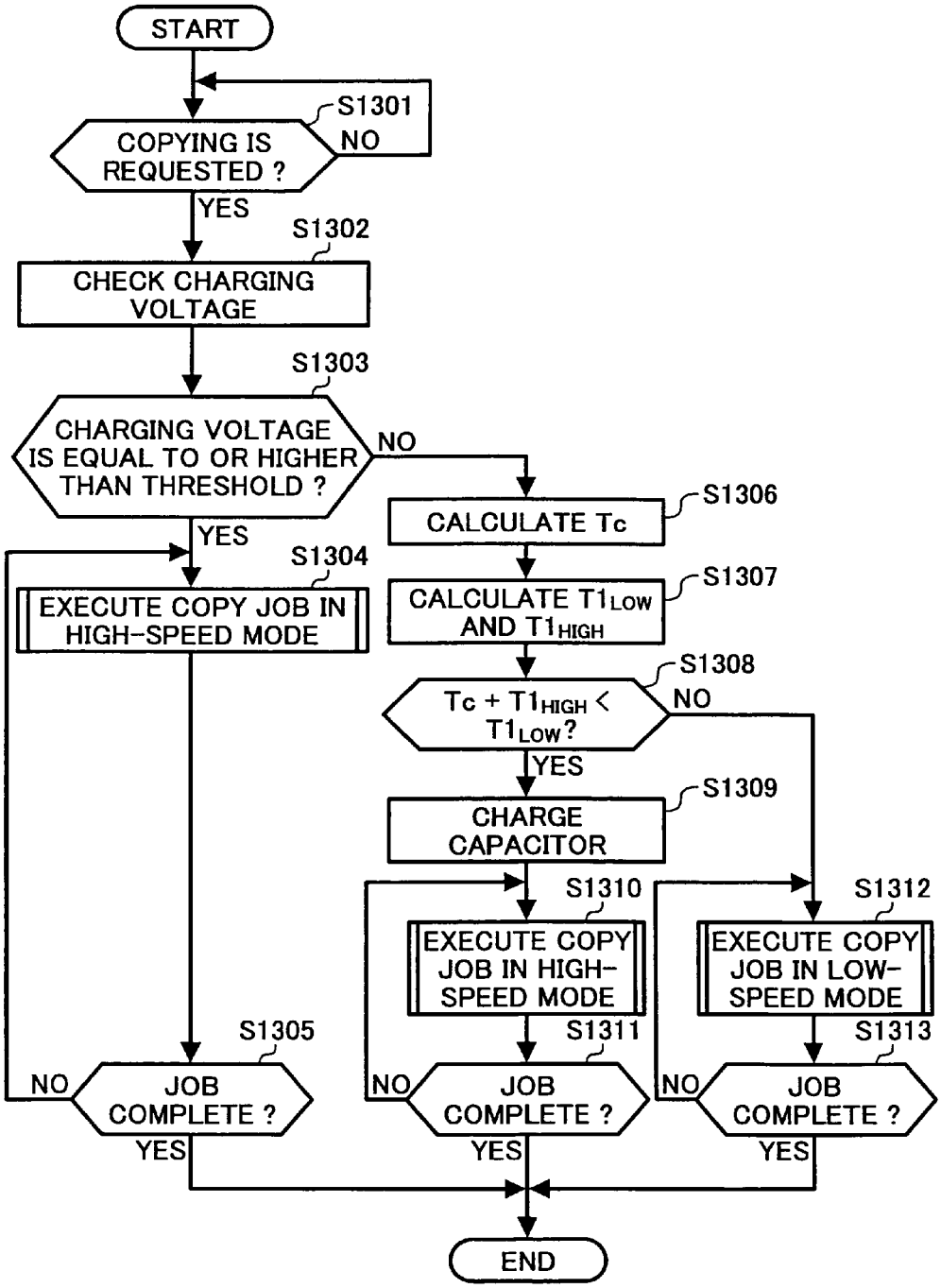
FIG. 13 is a flowchart of a process procedure for a copy job in a control unit of an image forming apparatus according to a first embodiment of the present invention.

FIG. 13 is a flowchart of a process procedure for a copy job in the control unit 202. The control for a copy job by the control unit 202 will be explained with reference to FIG. 13. When the operation unit 150 requests copying (step S1301), the control unit 202 checks a charging voltage at the capacitor CP1 (step S1302) and judges whether the charging voltage is equal to or higher than the threshold charging voltage decided in advance (e.g., 32 volts) (step S1303). Here, if the charging voltage at the time of the print operation request is lower than the threshold charging voltage, as shown in FIG. 11, it is likely that the capacitor CP1 having a small charging capacitance cannot supply power to the fixing heater HT1 sufficiently at the time when temperature of the fixing roller 151 falls, and fixing property defect occurs.

If the charging voltage at the capacitor CP1 is equal to or higher than the threshold charging voltage ("Yes" in step S1303), the control unit 202 executes the copy job in the high-speed mode (step S1304). Then, the control unit 202 continues the copy job in the high-speed mode until the copy job is completed (step S1305).

On the other hand, if the charging voltage at the capacitor CP1 is not equal to or higher than the threshold charging voltage ("No" in step S1303), the control unit 202 calculates the charging time Tc (step S1306). Then, the control unit 202 calculates the job completing time T1LOW in the low-speed mode and the job completing time T1HIGH in the high-speed mode according to the expressions (1) and (2) (step S1307).

Then, the control unit 202 judges whether Tc+T1HIGH is smaller than T1LOW (step S1308). Here, the control unit 202 judges in which of the following cases a turnaround time is shorter: a case in which the control unit 202 executes the copy job in the high-speed mode after charging the capacitor CP1 or a case in which the control unit 202 executes the copy job in the low-speed mode without charging the capacitor CP1. For example, when a large amount of copying is performed, a copy job may be completed faster if the control unit 202 executes the copy job in the high-speed mode after charging the capacitor CP1.

If Tc+T1HIGH is smaller than T1LOW ("Yes" in step S1308), the control unit 202 charges the capacitor CP1 until the charging voltage at the capacitor CP1 reaches the full charging voltage (e.g., 44 volts) (step S1309). Thereafter, the control unit 202 executes the copy job in the high-speed mode (step S1310). Then, the control unit 202 continues the copy job until the copy job is completed (step S1311). Note that, in this embodiment, the control unit 202 charges the capacitor CP1 until the charging voltage at the capacitor CP1 reaches the full charging voltage (e.g., 44 volts) in step S1309. However, the control unit 202 may control the copy job in the high-speed mode to be started before the charging voltage reaches the full charging voltage, for example, at a point when the charging voltage has reached the threshold voltage (e.g., 32 volts).

On the other hand, if Tc+T1HIGH is not smaller than T1LOW ("No" in step S1308), the control unit 202 executes the copy job in the low-speed mode without charging the capacitor CP1 (step S1312). Then, the control unit 202 continues the copy job in the low-speed mode until the copy job is completed (step S1313).

Figure 14:
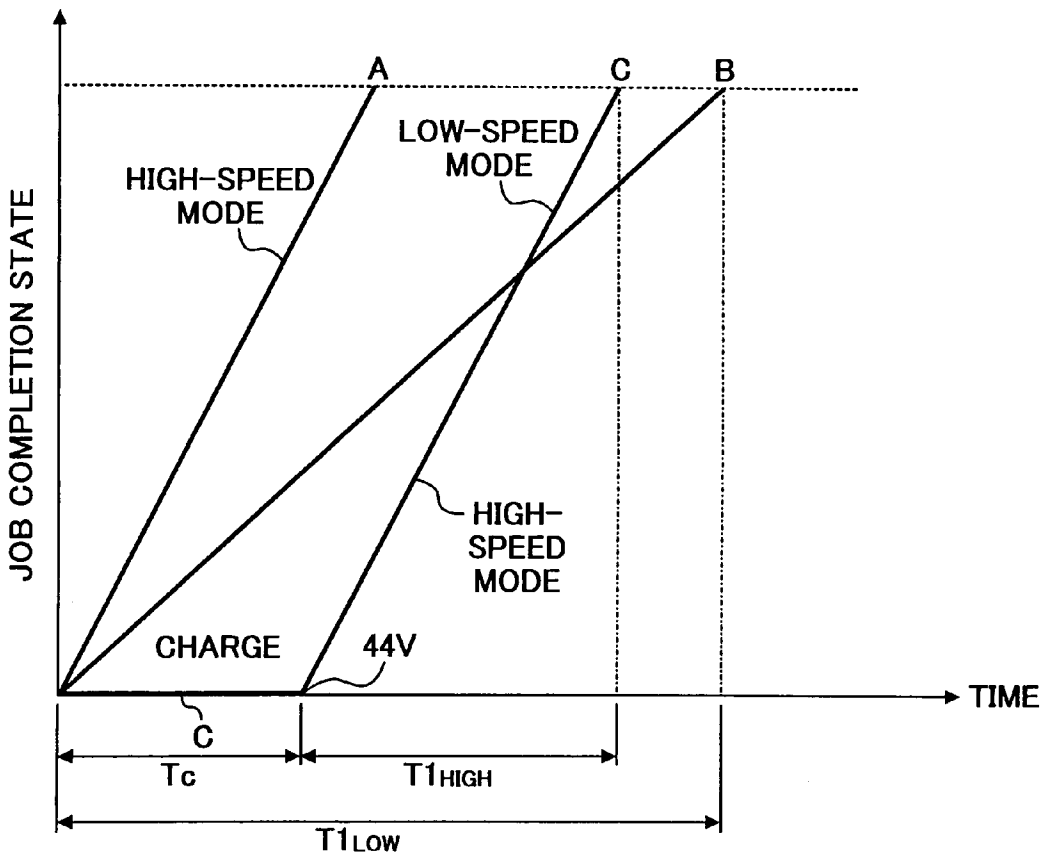
FIG. 14 is a graph for illustrating control for a copy job and a completion state of the job according to a state of a charging voltage at a capacitor CP1 when Tc+T1HIGH is smaller than T1LOW.
Figure 15:
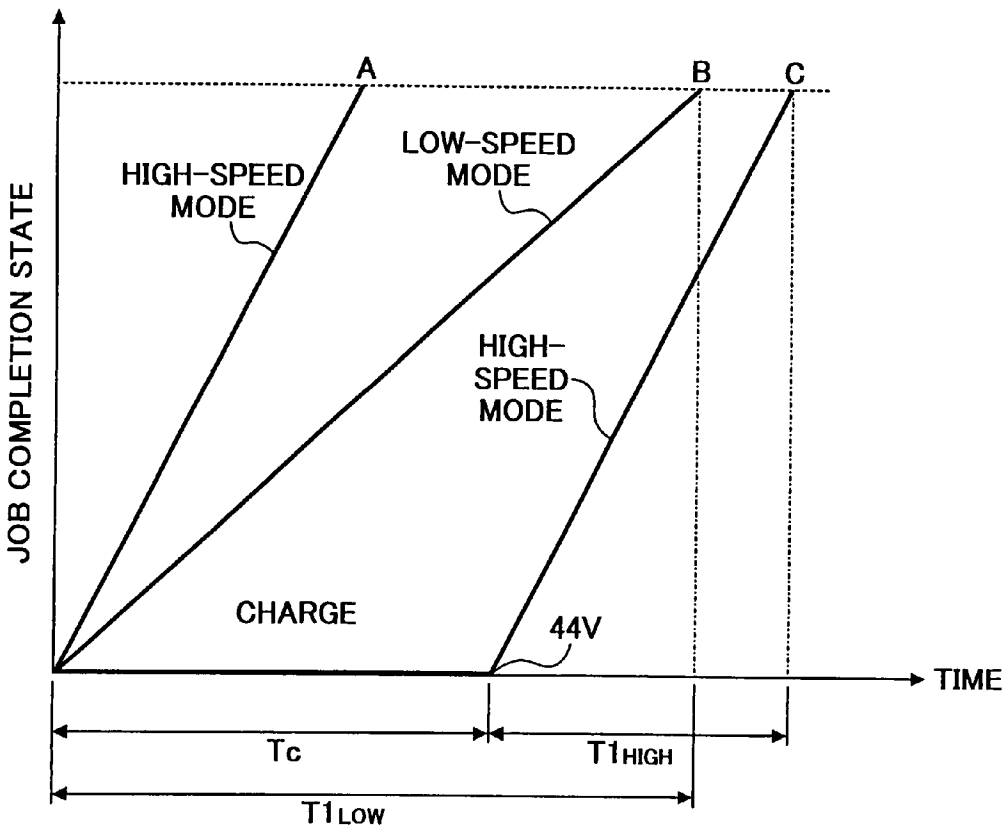
FIG. 15 is a graph for illustrating control for a copy job and a completion state of the job according to a state of a charging voltage at the capacitor CP1 when Tc+T1HIGH is not smaller than T1LOW.

FIG. 14 is a graph for illustrating control for a copy job and a completion state of the job according to a state of a charging voltage at a capacitor CP1 when Tc+T1HIGH is smaller than T1LOW. FIG. 15 is a graph for illustrating control for a copy job and a completion state of the job according to a state of a charging voltage at the capacitor CP1 when Tc+T1HIGH is not smaller than T1LOW. The horizontal axis represents an elapsed time from start of the job, and the vertical axis represents a completion state of the job (e.g., the number of copied sheets).

The graph A shown n FIG. 14 indicates a case in which the control unit 202 executes the copy job in the high-speed mode when it is judged in step S1303 that the charging voltage at the capacitor CP1 is equal to or higher than the threshold voltage 32 volts. The graph B indicates a case in which the control unit 202 executes the copy job in the low-speed mode, and a graph C indicates a case in which the control unit 202 executes the copy job in the high-speed mode after charging the capacitor CP1. In the example shown in FIG. 14, the job completing time in the case in which the control unit 202 executes the copy job in the low-speed mode from the beginning (graph B) (T1LOW) is longer than the job completing time in the case in which the control unit 202 executes the copy job in the high-speed mode after charging the capacitor CP1 (graph C) (Tc+T1HIGH). Thus, the control unit 202 judges in step S1308 that Tc+T1HIGH is smaller than T1LOW and controls the copy job to be executed in the high-speed mode after charging the capacitor CP1.

On the other hand, in the example shown in FIG. 15, the job completing time in the case in which the control unit 202 executes the copy job in the low-speed mode from the beginning (graph B) (T1LOW) is shorter than the job completing time in the case in which the control unit 202 executes the copy job in the high-speed mode after charging the capacitor CP1 (graph C) (Tc+T1HIGH). Thus, the control unit 202 judges in step S1308 that Tc+T1HIGH is not smaller than T1LOW and controls the copy job to be executed in the low-speed mode from the beginning.

According to the first embodiment, the control unit 202 calculates a charging time for charging the capacitor CP1 to a predetermined charging voltage and also calculates a turnaround time of a set copy job, and then controls execution of a charging operation for the capacitor CP1 and execution of the copy job based on the calculated charging time and the calculated turnaround time of the copy job such that the turnaround time of the copy job is minimized. Thus, when the capacitor CP1 is used as a power supply source for a fixing unit, even in a state in which the capacitor CP1 is not charged sufficiently, a completion time for the copy job can be minimized under the constraints.

Furthermore, according to the first embodiment, the image forming apparatus has the high-speed mode and the low-speed mode, and the control unit 202 calculates a turnaround time of a copy job set for each of the modes, executes the copy job in the high-speed mode after charging the capacitor CP1 when a sum of a charging time and the turnaround time of the copy job in the high-speed mode is smaller than the turnaround time of the copy job in the low-speed mode, and executes the copy job in the low-speed mode without charging the capacitor CP1 when the sum is not smaller than the turnaround time of the copy job in the low-speed mode. Thus, the control unit 202 can execute the copy job in one of the high-speed mode after charging the capacitor CP1 or the low-speed mode without charging the capacitor CP1 that requires a shorter time. This makes it possible to further reduce a time for the copy job.

Moreover, according to the first embodiment, the control unit 202 estimates the number of documents set in the ADF 10 and calculates a turnaround time of a copy job based on the estimated number of documents. This makes it possible to calculate the turnaround time of the copy job with a simple method.

The image forming apparatus uses the electric double layer capacitor as an auxiliary power supply. This makes it possible to reduce running cost for the image forming apparatus.

In the image forming apparatus according to the first embodiment, when copying is requested and a charging voltage at the capacitor CP1 is equal to or higher than a threshold voltage decided in advance, the control unit 202 executes a job in the high-speed mode until the job is completed. However, it is likely that, even if the control unit 202 executes a job in the high-speed mode from the beginning, fixing property defect occurs if a charging voltage at the capacitor CP1 falls to the threshold voltage during the execution of the job and power is not supplied from the capacitor CP1 to the fixing heater HT1 at the time when temperature of the fixing roller 151 falls.

Therefore, in the image forming apparatus according to a second embodiment of the present invention, a job completing time is further minimized by, when a voltage at the capacitor CP1 has decreased to a threshold voltage while the job is executed in the high-speed mode, switching the high-speed mode to the low-speed mode.

A structure of the image forming apparatus according to the second embodiment is the same as that in the first embodiment.

Figure 16:
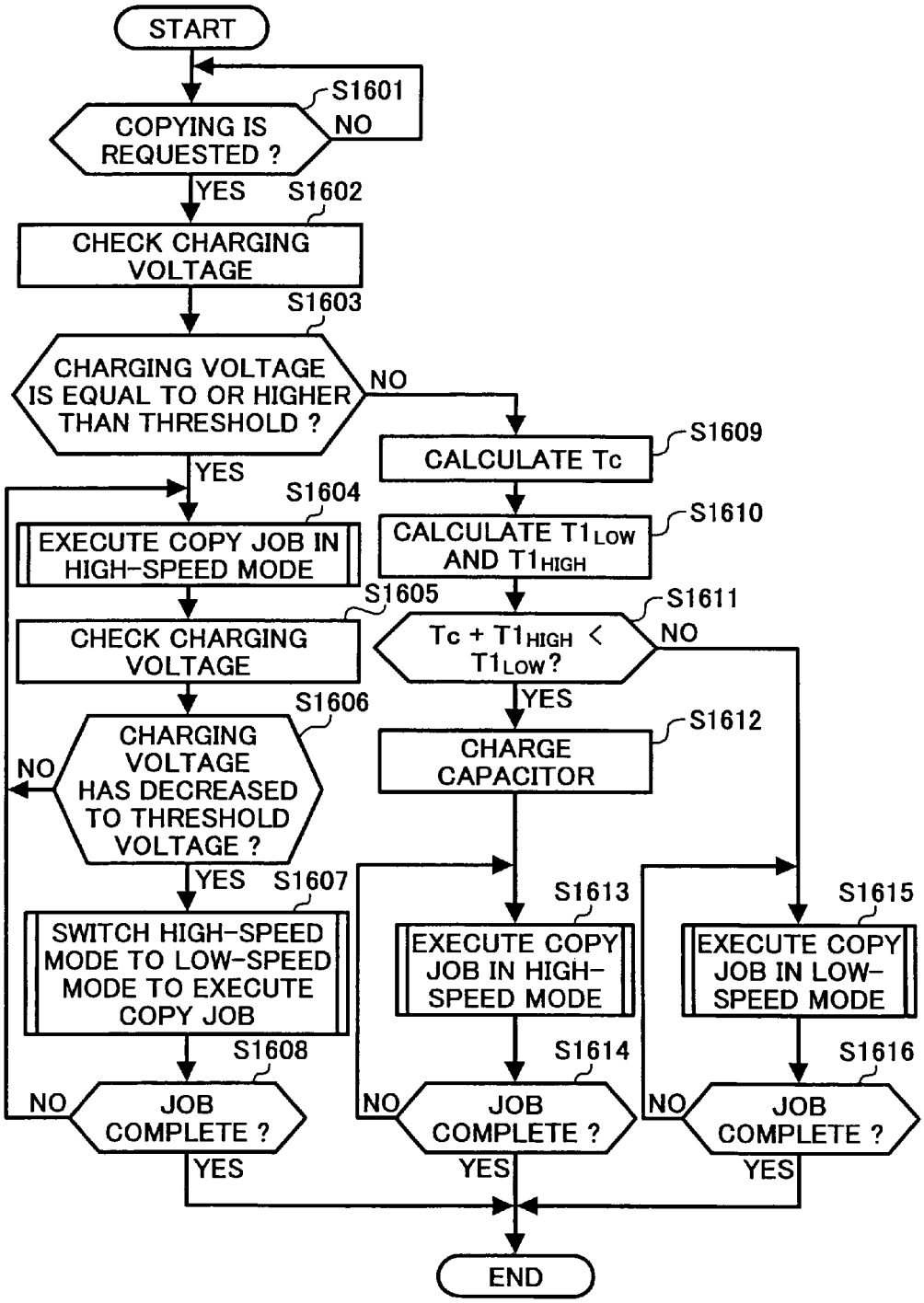
FIG. 16 is a flowchart of a process procedure for a copy job in a control unit of an image forming apparatus according to a second embodiment of the present invention.

FIG. 16 is a flowchart of a process procedure for a copy job in the control unit 202 of an image forming apparatus according to the second embodiment. The control for the copy job in the control unit 202 will be explained with reference to FIG. 16. When the operation unit 150 requests copying (step S1601), the control unit 202 checks a charging voltage at the capacitor CP1 (step S1602) and judges whether the charging voltage is equal to or higher than a threshold charging voltage decided in advance (e.g., 32 volts) (step S1603).

Processing at the time when the charging voltage at the capacitor CP1 is lower than the threshold charging voltage (steps S1609 to S1604 and S1616) is performed in the same manner as the processing for copy job control in the image forming apparatus according to the first embodiment (steps S1306 to S1311 and S1313).

On the other hand, in step S1603, if the charging voltage at the capacitor CP1 is equal to or higher than the threshold charging voltage ("Yes" in step S1603), the control unit 202 executes the copy job in the high-speed mode (step S1604). While the copy job is executed, the control unit 202 checks the charging voltage at the capacitor CP1 every fixed time (step S1605) and judges whether the charging voltage has decreased to the threshold charging voltage decided in advance (e.g., 32 volts) (step S1606). Then, if the charging voltage has not decreased to the threshold charging voltage ("No" in step S1606), the control unit 202 continues to execute the copy job in the high-speed mode.

On the other hand, in step S1606, if the charging voltage at the capacitor CP1 has decreased to the threshold charging voltage ("Yes" in step S1606), since it is likely that fixing property defect occurs unless power is supplied from the capacitor CP1 to the fixing heater HT1 at the time when temperature of the fixing roller 151 falls, the control unit switches the high-speed mode to the low-speed mode to execute the copy job (step S1607). Then, the control unit 202 continues the copy job until the copy job is completed (step S1608).

Figure 17:
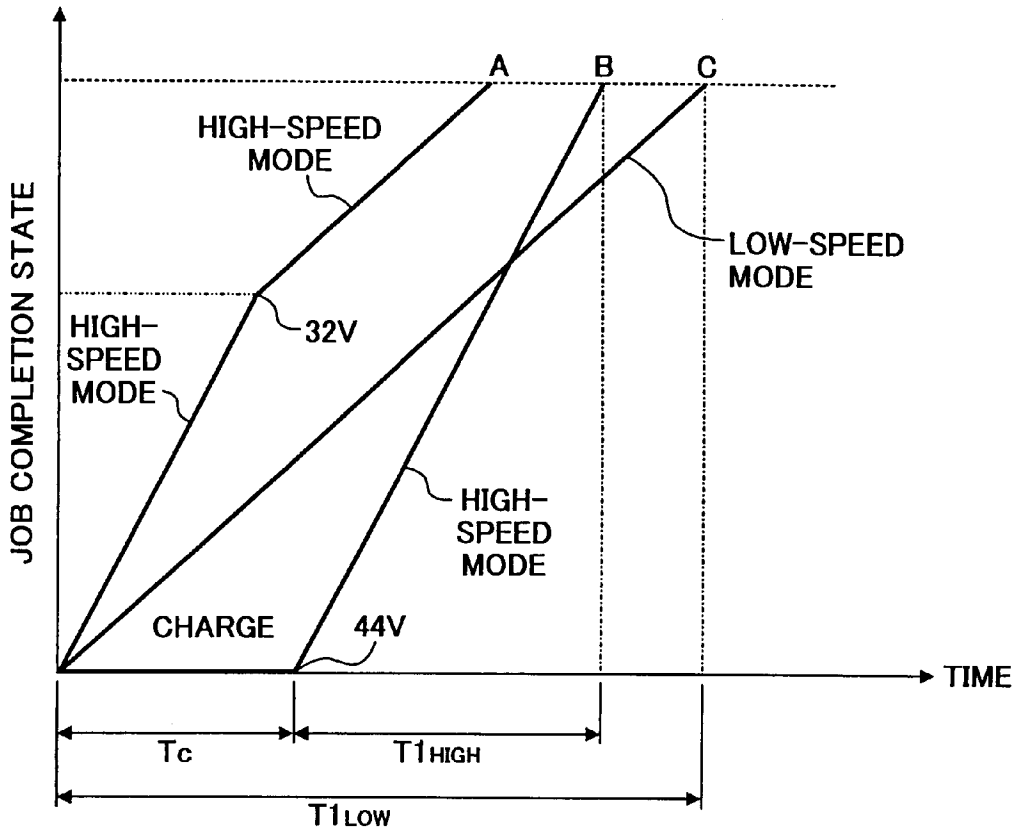
FIG. 17 is a graph for illustrating control for a copy job and a completion state of the job in the second embodiment.

FIG. 17 is a graph for illustrating control for a copy job and a completion state of the job in the second embodiment. The horizontal axis represents an elapsed time from start of the job, and the vertical axis represents a completion state of the job (e.g., the number of copied sheets).

The graph A indicates a case in which the control unit 202 executes the copy job in the high-speed mode when it is judged in step S1603 that the charging voltage at the capacitor CP1 is equal to or higher than the threshold voltage 32 volts. The graph B indicates a case in which the control unit 202 executes the copy job in the low-speed mode, and a graph C indicates a case in which the control unit 202 executes the copy job in the high-speed mode after charging the capacitor CP1.

As shown in the example of FIG. 17, even if it is judged in step S1603 that the charging voltage at the capacitor CP1 is equal to or higher than the threshold voltage 32 volts, at a point when the charging voltage at the capacitor CP1 has decreased to the threshold charging voltage (32 volts) (step S1606) while the control unit 202 is executing the job in the high-speed mode, the control unit 202 switches the high-speed mode to the low-speed mode to execute the copy job.

In this way, in the image forming apparatus according to the second embodiment, the control unit 202 performs job control to switch the high-speed mode to the low-speed mode at a point when the charging voltage at the capacitor CP1 has decreased to the threshold charging voltage while the control unit 202 is executing the job. Thus, when the capacitor CP1 is used as a power supply source for a fixing unit, even if the capacitor CP1 is charged sufficiently and the charging voltage decreases gradually, a completing time for a copy job can be further minimized by controlling the job more appropriately.

In the image forming apparatus according to the first and the second embodiments, when copying is requested and a charging voltage at the capacitor CP1 is lower than a threshold voltage decided in advance, the control unit 202 predicts a job completing time in the low-speed mode, a charging time, and a job completing time in the high-speed mode to control the job such that the job completing time is minimized. However, it is likely that, even if the control unit 202 executes a job in the high-speed mode after charging the capacitor CP1, fixing property defect occurs if a charging voltage at the capacitor CP1 falls to the threshold voltage during the execution of the job and power is not supplied from the capacitor CP1 to the fixing heater HT1 at the time when temperature of the fixing roller 151 falls.

Therefore, in the image forming apparatus according to a third embodiment of the present invention, a job completing time is further minimized by, when the control unit 202 executes a job in the high-speed mode after charging the capacitor CP1, predicting a job completing time at the time when a charging voltage at the capacitor CP1 falls to the threshold charging voltage during execution of the job and the control unit 202 switches the high-speed mode to the low-speed mode to execute the job.

A structure of the image forming apparatus according to the third embodiment is the same as that in the first embodiment.

Figure 18:
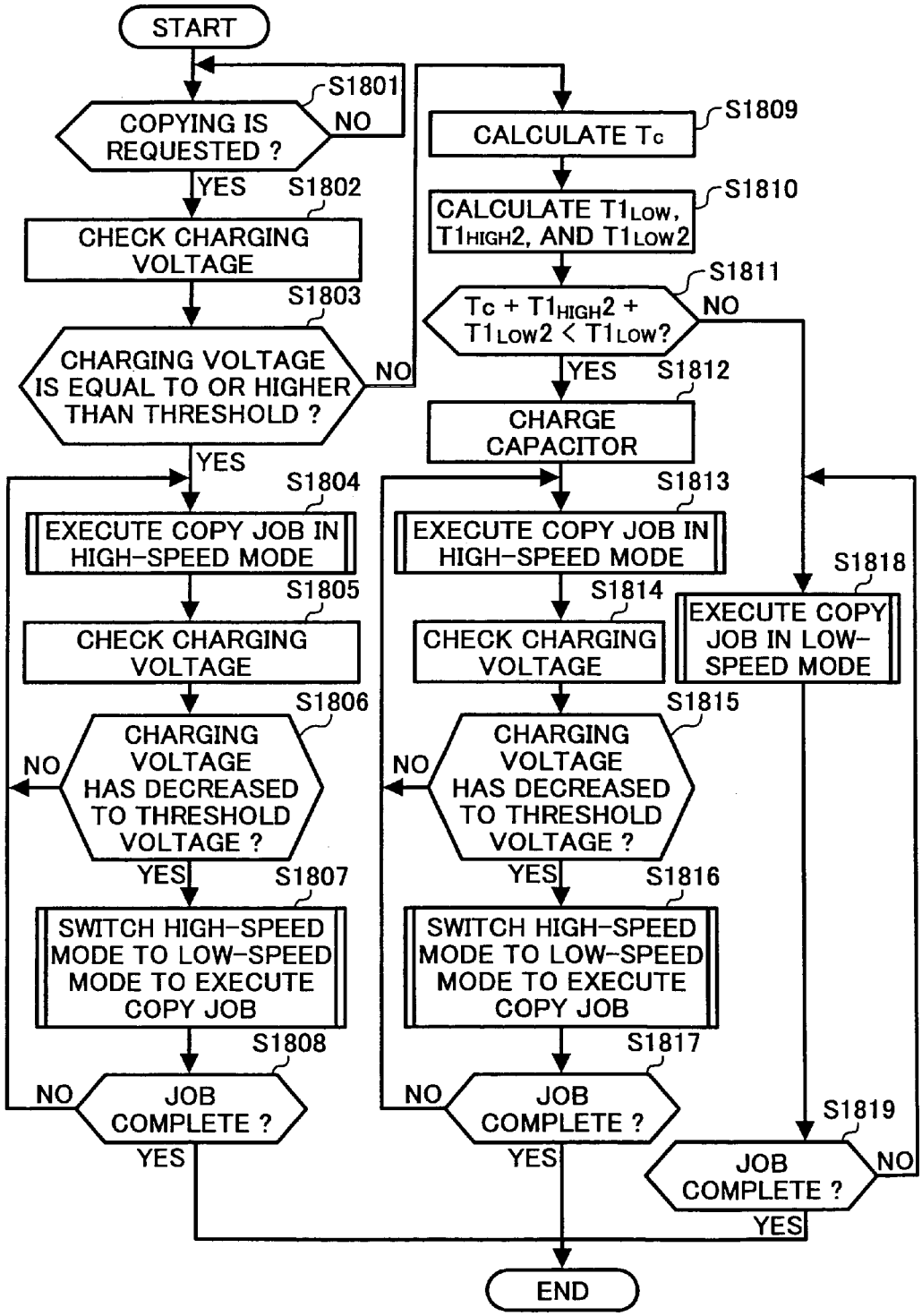
FIG. 18 is a flowchart of a process procedure for a copy job in a control unit of an image forming apparatus according to a third embodiment of the present invention.

FIG. 18 is a flowchart of a process procedure for a copy job in the control unit 202 of an image forming apparatus according to the third embodiment. The control for the copy job in the control unit 202 will be explained with reference to FIG. 18. When the operation unit 150 requests copying (step S1801), the control unit 202 checks a charging voltage at the capacitor CP1 (step S1802) and judges whether the charging voltage is equal to or higher than a threshold charging voltage decided in advance (e.g., 32 volts) (step S1803).

Then, if the charging voltage at the capacitor CP1 is equal to or higher than the threshold charging voltage ("Yes" in step S1803), the control unit 202 executes the copy job in the high-speed mode (step S1804). Since control processing of the job in this step and subsequent steps (steps S1804 to S1808) is the same as the job control processing of the image forming apparatus according to the second embodiment (steps S1604 to S1608), the control processing won't be explained again.

On the other hand, if the charging voltage at the capacitor CP1 is not equal to or higher than the threshold charging voltage ("N" in step S1803), the control unit 202 calculates a charging time Tc (step S1809). Here, the charging time Tc is calculated according to the expression (3) or (4) as in the first embodiment.

Subsequently, the control unit 202 calculates a job completing time T1LOW in the low-speed mode, a job execution time T1HIGH2 from start of job execution in the high-speed mode until a charging voltage at the capacitor CP1 falls to the threshold charging voltage (e.g., 32 volts), and a completing time T1LOW2 from start of a job in the low-speed mode in a state in which a charging voltage at the capacitor CP1 is the threshold charging voltage until completion of the job (step S1810).

Here, T1LOW is calculated according to the expression (2) as in the first embodiment. T1HIGH2 and T1LOW are calculated according to following expressions (5) and (6), respectively.

$$T1\text{HIGH2}=nc/sh\ (CPM) \quad (5)$$

$$T1\text{LOW2}=(ns-nc)/sl\ (CPM) \quad (6)$$

where $n_c$ is predicted number of copied sheets up to a point when the charging voltage at the capacitor CP1 falls to the threshold charging voltage, sh is speed at the time of the high-speed mode, ns is set number of sheets, and sl is speed at the time of the low-speed mode.

Note that the predicted number of copied sheets up to a point when the charging voltage at the capacitor CP1 falls to the threshold charging voltage only has to be found in advance by, for example, a method of executing a job in the high-speed mode plural times and calculating an average of the number of copied sheets in the plural times of execution of the job. In addition, the job is executed plural times because the number of copied sheets changes depending on conditions such as an environment in which the image forming apparatus is used, a type of paper, and a type of an image pattern or the like.

Then, the control unit 202 judges whether Tc+T1HIGH2+T1LOW2 is smaller than T1LOW (step s1811). Here, the control unit 202 judges in which of the following cases a turnaround time is short: a case in which the control unit 202 executes a copy job in the high-speed mode after charging the capacitor CP1 and switches the high-speed mode to the low-speed mode to execute the job at a point when the charging voltage at the capacitor CP1 has fallen to the threshold charging voltage, and a case in which the control unit 202 executes the copy job in the low-speed mode without charging the capacitor CP1.

If Tc+T1HIGH2+T1LOW2 is smaller than T1LOW ("Yes" in step S1811, the control unit 202 charges the capacitor CP1 until the charging voltage at the capacitor CP1 reaches a full charging voltage (e.g., 44 volts) (step S1812), and then executes the copy job in the high-speed mode (step S1813). During the execution of the copy job, the control unit 202 checks the charging voltage at the capacitor CP1 every fixed time (step S1814) and judges whether the charging voltage has decreased to the threshold charging voltage decided in advance (e.g., 32 volts) (step S1815). Then, if the charging voltage has not decreased to the threshold charging voltage ("No" in step S1815), the control unit 202 continues to execute the copy job in the high-speed mode.

On the other hand, if the charging voltage at the capacitor CP1 has decreased to the threshold charging voltage ("Yes" in step S1815), it is likely that fixing property defect occurs unless power is supplied form the capacitor CP1 to the fixing heater HT1 at the time when temperature of the fixing roller 151 falls. Thus, the control unit 202 switches the high-speed mode to the low-speed mode to execute the copy job (step S1816). Then, the control unit 202 continues the copy job until the copy job is completed (step S1817).

On the other hand, if Tc+T1HIGH2+T1LOW2 is not smaller than T1LOW ("N" in step S1811), the control unit 202 executes the copy job in the low-speed mode without charging the capacitor CP1 (step S1818). Then, the control unit 202 continues the copy job in the low-speed mode until the copy job is completed (step S1819).

Figure 19:
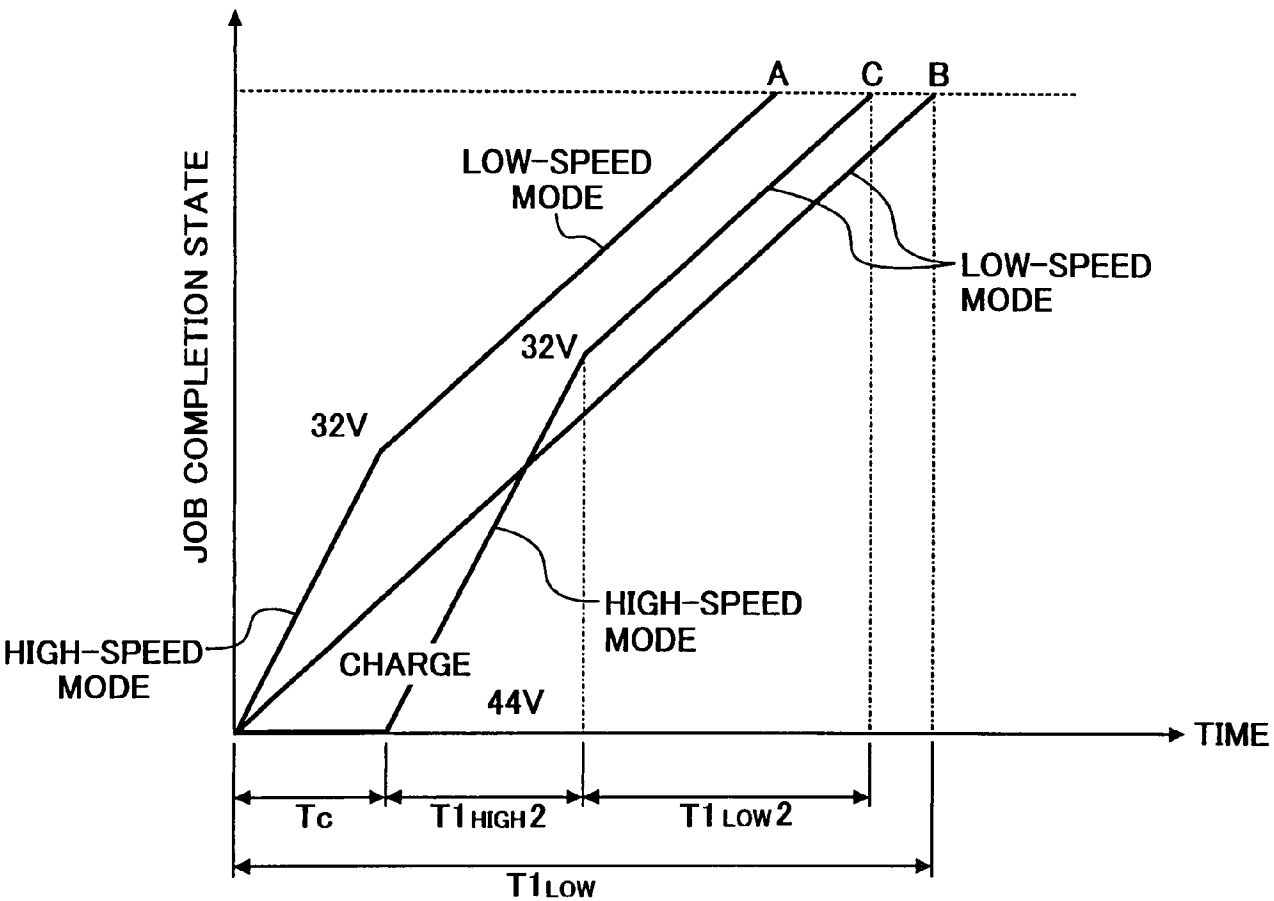
FIG. 19 is a graph for illustrating control for a copy job and a completion state of the job according to a state of a charging voltage at the capacitor CP1 when Tc+T1HIGH2+T1LOW2 is smaller than T1LOW.
Figure 20:
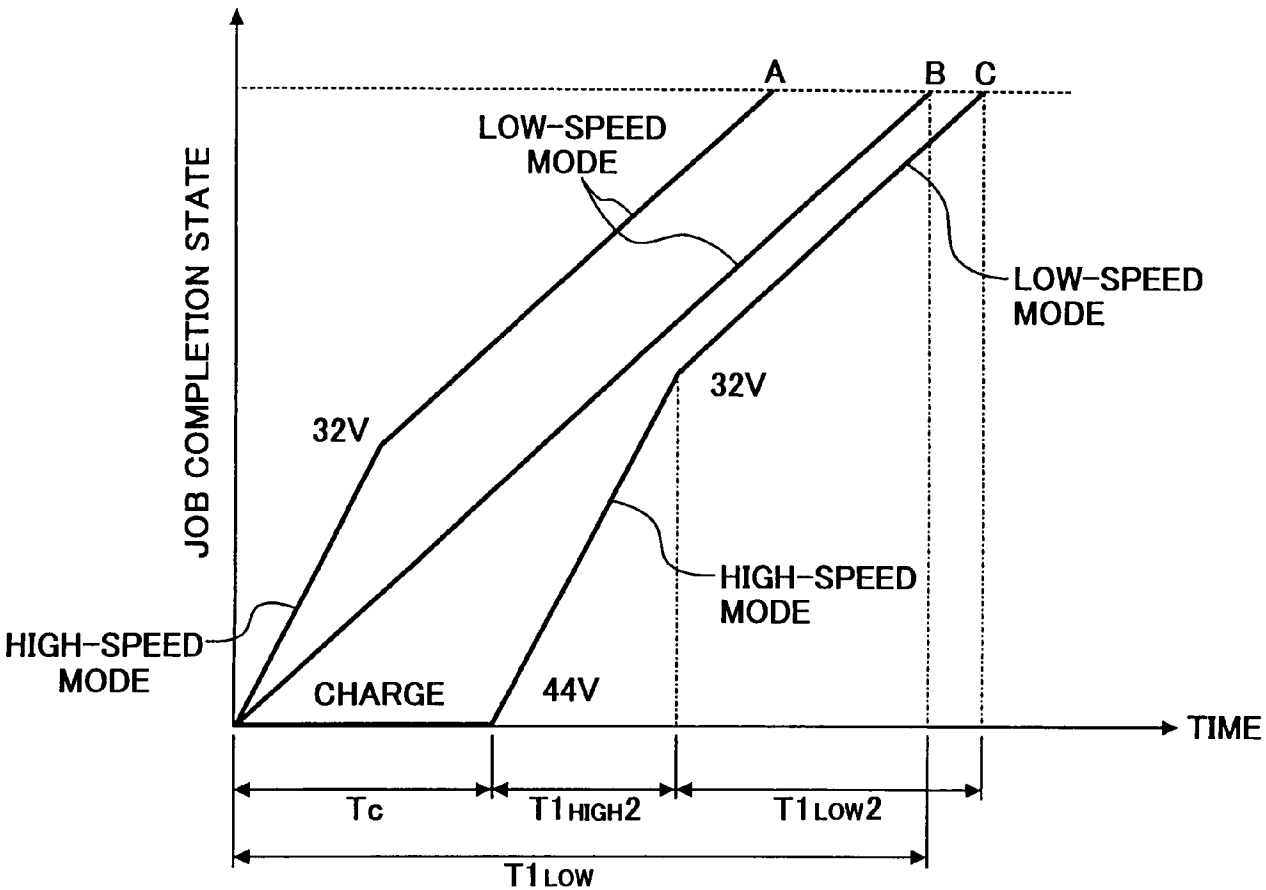
FIG. 20 is a graph for illustrating control for a copy job and a completion state of the job according to a state of a charging voltage at the capacitor CP1 when Tc+T1HIGH2+T1LOW2 is not smaller than T1LOW.

FIG. 19 is a graph for illustrating control for a copy job and a completion state of the job according to a state of a charging voltage at the capacitor CP1 when Tc+T1HIGH2+T1LOW2 is smaller than T1LOW. FIG. 20 is a graph for illustrating control for a copy job and a completion state of the job according to a state of a charging voltage at the capacitor CP1 when Tc+T1HIGH2+T1LOW2 is not smaller than T1LOW. The horizontal axis represents an elapsed time from start of the job, and the vertical axis represents a completion state of the job (e.g., the number of copied sheets).

The graph A shown in FIG. 19 indicates a case in which the control unit 202 executes the copy job in the high-speed mode when it is judged in step S1803 that the charging voltage at the capacitor CP1 is equal to or higher than the threshold voltage 32 volts. The graph B indicates a case in which the control unit 202 executes the copy job in the low-speed mode. A graph C indicates a case in which the control unit 202 executes the copy job in the high-speed mode after charging the capacitor CP1 and switches the high-speed mode to execute the job at a point when the charging voltage at the capacitor CP1 has fallen to the threshold charging voltage. In the example shown in FIG. 19, the job completing time in the case in which the control unit 202 executes the copy job in the low-speed mode from the beginning (graph B) (T1LOW) is longer than the job completing time in the case in which the control unit 202 executes the copy job in the high-speed mode after charging the capacitor CP1 and switches the high-speed mode to execute the job at a point when the charging voltage at the capacitor CP1 has fallen to the threshold charging voltage (graph C) (Tc+T1HIGH2+T1LOW2). Thus, the control unit 202 judges in step S1811 that Tc+T1HIGH2+T1LOW2 is smaller than T1LOW and controls the copy job to be executed in the high-speed mode after charging the capacitor CP1.

On the other hand, in the example shown in FIG. 20, the job completing time in the case in which the control unit 202 executes the copy job in the low-speed mode from the beginning (graph B) (T1LOW) is shorter than the job completing time in the case in which the control unit 202 executes the copy job in the high-speed mode after charging the capacitor CP1 and switches the high-speed mode to execute the job at a point when the charging voltage at the capacitor CP1 has fallen to the threshold charging voltage (graph C) (Tc+T1HIGH2+T1LOW2). Thus, the control unit 202 judges in step S1811 that Tc+T1HIGH2+T1LOW2 is not smaller than T1LOW and controls the copy job to be executed in the low-speed mode from the beginning.

In this way, in the image forming apparatus according to the third embodiment, when the control unit 202 executes a job in the high-speed mode after charging the capacitor CP1, the control unit 202 performs job control to switch the high-speed mode to the low-speed mode at a point when the charging voltage at the capacitor CP1 has decreased to the threshold charging voltage while the control unit 202 is executing the job. Thus, when the capacitor CP1 is used as a power supply source for a fixing unit, even if the capacitor CP1 is charged sufficiently and the charging voltage decreases gradually, a completing time for a copy job can be further minimized by controlling the job more appropriately.

Note that, although the image forming apparatuses according to the first to the third embodiments have the high-speed mode and the low-speed mode as operation modes, the image forming apparatuses may have modes of three stages, namely, a high-speed mode, a medium-speed mode, and a low-speed mode.

In the first to the third embodiments, the reduction of a turnaround time of a copy job at the time when the copy function of the image formation apparatus in FIG. 1 is used is explained. However, it is also possible to reduce a turnaround time of a printer job when the printing function of the image forming apparatus is used. In this case, the image forming apparatus interprets a print instruction inputted from an external personal computer or the like, calculates the number of pages of print data and the number of sheets to be printed, and calculates a turnaround time of the printer job according to the following expression: the number of pages×the number of sheets to be printed×print time per one sheet. Since other operations are the same as those in the first embodiment, the operations won't be explained again.

Note that, in the second and the third embodiments, a predetermined voltage, with which a charging voltage at the capacitor CP1 is checked and compared in the beginning of job control, and a threshold voltage, with which the charging voltage is checked and compared during execution of a job, are set to be an identical value. However, the threshold voltage may be set to a different value.

In addition, the present invention is not limited to the above-mentioned embodiments but may be modified and executed appropriately as long as such a modification does not depart from the scope of the present invention.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. An image forming apparatus comprising:

a fixing unit that thermally fixes a toner image using a fixing member, the fixing unit heated by a heat generating member that generates heat by power supply from a chargeable auxiliary power supply;

a power control unit that controls the power supply from the auxiliary power supply to the heat generating member based on a charging voltage of the auxiliary power supply;

a job-turnaround-time predicting unit that predicts a job turnaround time required for executing an image forming job;

a charging-time predicting unit that predicts a charging time for charging the auxiliary power supply to a predetermined charging voltage based on the charging voltage of the auxiliary power supply; and a control unit that controls a charging operation for the auxiliary power supply and execution of the image forming job based on the job turnaround time predicted and the charging time predicted, such that the job turnaround time for the image forming job is minimized.

2. The image forming apparatus according to claim 1, further comprising an automatic document feeder that conveys a document to an image reading surface, wherein the job-turnaround-time predicting unit estimates number of documents set in the automatic document feeder, and predicts the job turnaround time for the image forming job based on the number of documents estimated.

3. The image forming apparatus according to claim 1, wherein the control unit includes at least two operation modes with different operation speeds.

4. The image forming apparatus according to claim 3, wherein the job-turnaround-time predicting unit predicts the job turnaround time required for executing the image forming job for each of the operation modes, and the control unit executes the image forming job in either of the operation modes based on the job turnaround time predicted for each of the operation modes and the charging time.

5. The image forming apparatus according to claim 4, wherein the control unit includes a first high-speed mode for executing the image forming job at a high speed and a second low-speed mode for executing the image forming job at a low speed, the job-turnaround-time predicting unit predicts job turnaround times in the first high-speed mode and the first low-speed mode as a high-speed turnaround time and a low-speed turnaround time, respectively, and the control unit executes the image forming job in the first high-speed mode after completing the charging for the auxiliary power supply when a sum of the charging time predicted and the high-speed turnaround time is smaller than the low-speed turnaround time.

6. The image forming apparatus according to claim 5, wherein the control unit executes the image forming job in the first low-speed mode when the sum of the charging time predicted and the high-speed turnaround time is equal to or bigger than the low-speed turnaround time.

7. The image forming apparatus according to claim 4, wherein the control unit includes a first high-speed mode for executing the image forming job at a high speed and a first low-speed mode for executing the image forming job at a low speed, the job-turnaround-time predicting unit predicts job turnaround times in the first high-speed mode and the first low-speed mode as a high-speed turnaround time and a low-speed turnaround time, respectively, and the control unit executes the image forming job in the first high-speed mode when the charging voltage of the auxiliary power supply is equal to or higher than the predetermined charging voltage.

8. The image forming apparatus according to claim 7, wherein when the charging voltage at the auxiliary power supply is lower than the predetermined charging voltage, and when a sum of the charging time predicted and the high-speed turnaround time is smaller than the low-speed turnaround time, executes the image forming job in the first high-speed mode after completing the charging for the auxiliary power supply.

9. The image forming apparatus according to claim 8, wherein when the sum of the charging time predicted and the high-speed turnaround time is equal to or bigger than the low-speed turnaround time, the control unit executes the image forming job in the first low-speed mode.

10. The image forming apparatus according to claim 7, wherein when the charging voltage of the auxiliary power supply is equal to or higher than the predetermined charging voltage, the control unit executes the image forming job in the first high-speed mode, and when the charging voltage of the auxiliary power supply falls to a threshold voltage decided in advance during execution of the job, the control unit switches from the first high-speed mode to the first low-speed mode to execute the image forming job.

11. The image forming apparatus according to claim 7, wherein the job-turnaround-time predicting unit further predicts a turnaround time required from when the control unit starts the image forming job in the high-speed mode until when the charging voltage falls to a threshold voltage decided in advance during execution of the image forming job as a second high-speed turnaround time, and predicts a turnaround time required form when the charging voltage falls to the threshold voltage until when the control unit completes the image forming job in the low-speed mode as a second low-speed turnaround time, when the charging voltage at the auxiliary power supply is lower than the predetermined charging voltage, and when a sum of the predicted charging time, the second high-speed turnaround time, and the second low-speed turnaround time is smaller than the first low-speed turnaround time, executes the image forming job in the first high-speed mode after completing the charging for the auxiliary power supply, and when the charging voltage of the auxiliary power supply falls to the threshold voltage during execution of the job, the control unit switches from the first high-speed mode to the first low-speed mode to execute the image forming job.

12. The image forming apparatus according to claim 11, wherein when the sum of the predicted charging time, the second high-speed turnaround time, and the second low-speed turnaround time is equal to or bigger than the first low-speed turnaround time, the control unit executes the image forming job in the first high-speed mode.

13. The image forming apparatus according to claim 1, wherein the image forming job is either of a photocopying job and a printing job.

14. The image forming apparatus according to claim 1, wherein the auxiliary power supply is an electric double-layer capacitor.

15. A method of forming an image with a fixing unit that thermally fixes a toner image using a fixing member, the fixing unit heated by a heat generating member that generates heat by power supply from a chargeable auxiliary power supply, comprising:

controlling the power supply from the auxiliary power supply to the heat generating member based on a charging voltage of the auxiliary power supply;

predicting a job turnaround time required for executing an image forming job;

predicting a charging time for charging the auxiliary power supply to a predetermined charging voltage based on the charging voltage of the auxiliary power supply; and controlling a charging operation for the auxiliary power supply and execution of the image forming job based on the job turnaround time predicted and the charging time predicted, such that the job turnaround time for the image forming job is minimized.

16. A fixing unit that thermally fixes a toner image using a fixing member, the fixing unit heated by a heat generating member that generates heat by power supply from a chargeable auxiliary power supply, comprising:

a power control unit that controls the power supply from the auxiliary power supply to the heat generating member based on a charging voltage of the auxiliary power supply;

a job-turnaround-time predicting unit that predicts a job turnaround time required for executing an image forming job;

a charging-time predicting unit that predicts a charging time for charging the auxiliary power supply to a predetermined charging voltage based on the charging voltage of the auxiliary power supply; and a control unit that controls a charging operation for the auxiliary power supply and execution of the image forming job based on the job turnaround time predicted and the charging time predicted, such that the job turnaround time for the image forming job is minimized.

* * * * *